US011038291B2

(12) United States Patent
Inamasa

(10) Patent No.: US 11,038,291 B2
(45) Date of Patent: Jun. 15, 2021

(54) INSULATING COVER

(71) Applicant: TOSHIBA MITSUBISHI-ELECTRIC INDUSTRIAL SYSTEMS CORPORATION, Chuo-ku (JP)

(72) Inventor: Keisuke Inamasa, Tokyo (JP)

(73) Assignee: TOSHIBA MITSUBISHI-ELECTRIC INDUSTRIAL SYSTEMS CORPORATION, Chuo-ku (JP)

( * ) Notice: Subject to any disclaimer, the term of this patent is extended or adjusted under 35 U.S.C. 154(b) by 0 days.

(21) Appl. No.: 16/623,238

(22) PCT Filed: Jun. 1, 2018

(86) PCT No.: PCT/JP2018/021191
§ 371 (c)(1),
(2) Date: Dec. 16, 2019

(87) PCT Pub. No.: WO2019/229976
PCT Pub. Date: Dec. 5, 2019

(65) Prior Publication Data

US 2021/0151910 A1 May 20, 2021

(51) Int. Cl.
*H01R 9/24* (2006.01)
*H01R 9/22* (2006.01)
*H01R 4/18* (2006.01)

(52) U.S. Cl.
CPC ..... *H01R 9/223* (2013.01); *H01R 4/183* (2013.01); *H01R 9/2416* (2013.01)

(58) Field of Classification Search
CPC ..... H01T 13/06; H01R 4/20; H01R 13/113; H01R 4/5033
(Continued)

(56) References Cited

U.S. PATENT DOCUMENTS 4,869,682 A * 9/1989 Volk ..... H04Q 1/028 439/344
6,451,449 B2 * 9/2002 Asakura ..... C23C 28/023 428/615
(Continued)

FOREIGN PATENT DOCUMENTS

JP 56-29877 U 3/1981
JP 60-50461 U 4/1985
(Continued)

OTHER PUBLICATIONS

International Search Report dated Aug. 7, 2018 in PCT/JP2018/021191 filed on Jun. 1, 2018, 2 pages.

*Primary Examiner* — Phuong Chi Thi Nguyen
(74) *Attorney, Agent, or Firm* — Oblon, McClelland, Maier & Neustadt, L.L.P.

(57) ABSTRACT

An insulating cover includes a cover main body and a pair of supporters. The cover main body is open in one direction along a radial direction of a tubular portion of a crimp terminal. The cover main body is configured to be disposed outside a terminal base. The cover main body is configured not to cover at least a region of a plate portion of the crimp terminal. The region is configured to face an electrical connection portion of the terminal base. The cover main body is configured to cover the tubular portion. The pair of supporters is configured to face at least one of an electrical wire and the tubular portion on a side opposite to the cover main body.

13 Claims, 16 Drawing Sheets

(58) Field of Classification Search
USPC ..... 439/128, 886, 427, 852; 428/615; 174/74 R, 84 C; 257/687
See application file for complete search history.

(56) References Cited

U.S. PATENT DOCUMENTS

| | | | | |
|---|---|---|---|---|
| 7,094,113 | B1 * | 8/2006 | Hasenour | H01R 4/44 439/709 |
| 9,647,370 | B2 * | 5/2017 | Uchida | H01R 13/426 |
| 9,915,003 | B2 * | 3/2018 | Gaertner | H01R 13/03 |
| 2001/0008709 | A1 * | 7/2001 | Asakura | H01R 13/03 428/647 |
| 2011/0014825 | A1 * | 1/2011 | Drew | C23F 13/08 439/877 |
| 2013/0040509 | A1 * | 2/2013 | Mitose | H01R 4/62 439/877 |
| 2016/0064847 | A1 * | 3/2016 | Gaertner | C23C 2/06 439/741 |
| 2017/0342571 | A1 * | 11/2017 | Gaertner | H01R 4/26 |

FOREIGN PATENT DOCUMENTS

| | | | |
|---|---|---|---|
| JP | 60-78580 | U | 5/1985 |
| JP | 10-223280 | A | 8/1998 |

* cited by examiner

INSULATING COVER

TECHNICAL FIELD

Embodiments of the present invention relate to an insulating cover.

BACKGROUND ART

As an insulating component for securing insulation of a tubular portion of a crimp terminal, a crimp terminal provided with an insulating sheath or a tubular insulating cap is known.

However, types of crimp terminals provided with insulating sheaths are classified depending on sizes of screws used for the crimp terminal in addition to sizes of electrical wires. Therefore, there is a need to store a varied inventory in a case where a crimp terminal provided with an insulating sheath is used. Also, it is difficult to perform retrofit or replacement in many cases in either case using a crimp terminal provided with an insulating sheath or using an insulating cap.

PRIOR ART LITERATURE

Patent Literature

[Patent Literature 1]
Japanese Unexamined Patent Application, First Publication No. H10-223280

SUMMARY OF INVENTION

Issue to be Solved by Invention

The issue to be solved by the present invention is to provide an insulating cover which has a high versatility and which is capable of undergoing retrofit or replacement.

Means for Solving the Issue

An insulating cover according to an embodiment is for an electrical connection structure that includes an electrical wire, a crimp terminal, and a terminal base. The electrical wire includes a conductor and an insulator. The insulator covers the conductor. An end portion of the conductor projects to an outside of the insulator. The crimp terminal includes a tubular portion into which the end portion of the conductor is inserted and a plate portion provided integrally with the tubular portion. The terminal base includes an electrical connection portion to which the plate portion is connected and a cover configured to cover the plate portion on a side opposite to the electrical connection portion. The insulating cover includes a cover main body and a pair of supporters. The cover main body is open in at least one direction along a radial direction of the tubular portion. The cover main body is configured to be disposed outside the terminal base. The cover main portion is configured not to cover at least a region of the plate portion. The region is configured to face the electrical connection portion. The cover main body is configured to cover the tubular portion. The pair of supporters is configured to face the electrical wire on a side opposite to the cover main body.

MODE FOR CARRYING OUT INVENTION

Figure 1:
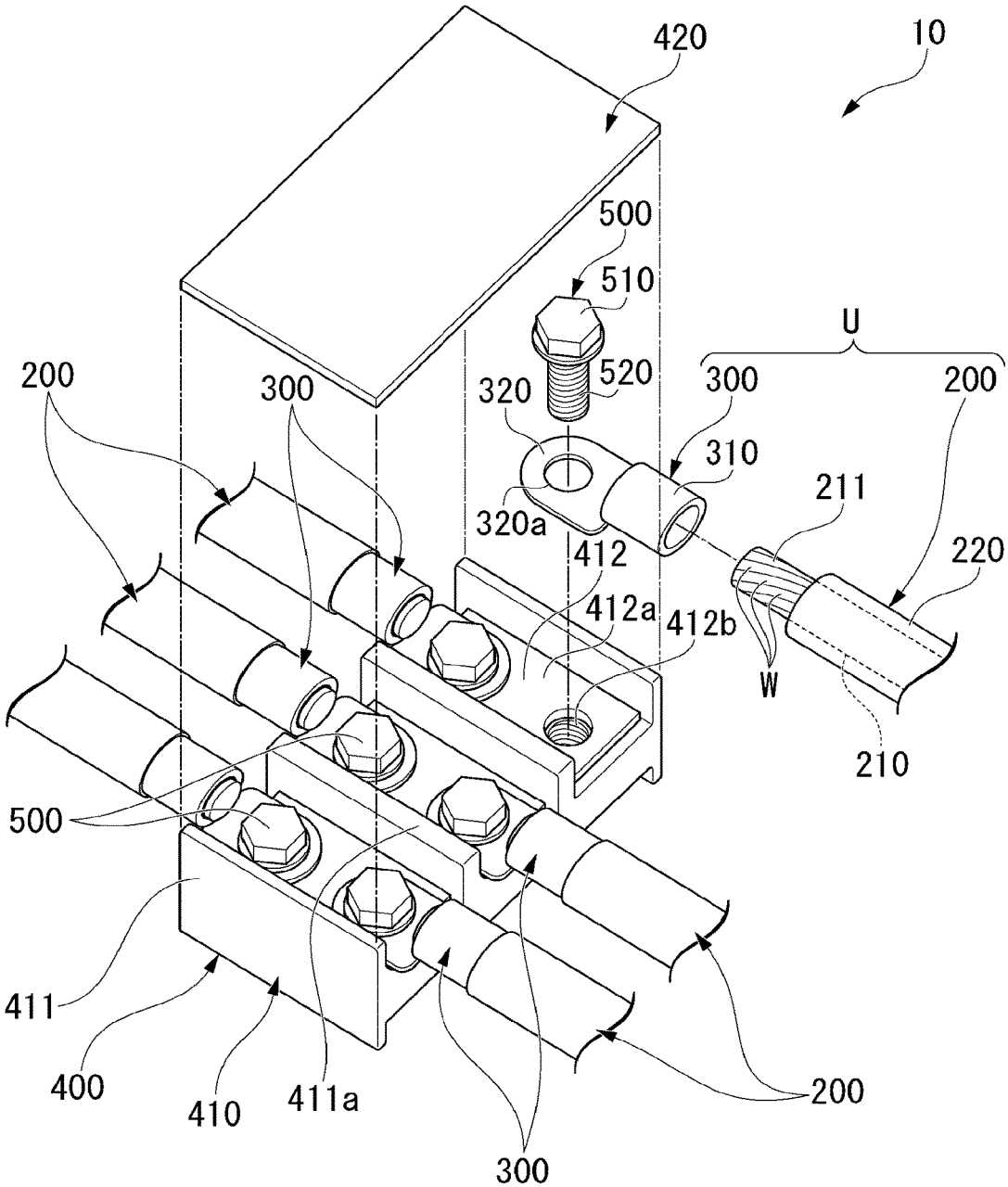
FIG. 1 is a perspective view illustrating an example of an electrical connection structure for explaining a first embodiment in a partially exploded manner

Hereinafter, insulating covers according to embodiments will be described with reference to drawings. In addition, the same reference numerals will be provided to components with the same or similar functions in the following description. And, repeated description of these components may be omitted.

First Embodiment

Referring to FIGS. 1 to 10, an insulating cover 100 according to a first embodiment will be described. First, an example of an electrical connection structure 10 for which the insulating cover 100 is used will be described. The electrical connection structure 10 is common in second to sixth embodiments, which will be described later, for example. However, the insulating cover 100 in each embodiment can be widely applied to various electrical connection structures that are not limited to the examples described below.

FIG. 1 is a perspective view illustrating an example of the electrical connection structure 10 in a partially exploded manner. The electrical connection structure 10 includes, for example, a plurality of electrical wires 200, a plurality of crimp terminals 300, a terminal base 400, and a plurality of fixing members 500. In addition, the crimp terminal 300 and the electrical wire 200 that are connected to each other will be collectively referred to as an "electrical wire unit U" in this specification.

The electrical wire 200 includes a conductor (inner conductor) 210 and an insulator (insulating layer) 220. The conductor 210 may be formed of one wire W or may be formed of a plurality of wires W which are bundled. The conductor 210 has a substantially circular section. The insulator 220 cover a circumferential surface of the conductor 210. The conductor 210 includes an end portion 211 that projects to the outside of the insulator 220.

The crimp terminal 300 is a so-called bare crimp terminal. The crimp terminal 300 includes a tubular portion (crimp portion) 310 and a plate portion (terminal portion) 320.

The tubular portion 310 is formed in a tubular shape, and the end portion 211 of the conductor 210 of the electrical wire 200 is inserted into the tubular portion 310. The "tubular portion" and "tubular shape" in this specification are not limited to a case in which the tubular portion 310 is formed in a tubular shape in advance, and a case in which a material formed in a flat shape, a U shape, or the like is formed into a tubular shape so as to wrap around the conductor 210 at the time of connection to the conductor 210 is also included. Also, "insertion" in the specification is not limited to a case in which the end portion 211 of the conductor 210 is inserted into the tubular portion 310 formed in a tubular shape in advance, and a case in which the end portion 211 of the conductor 210 is located inside the tubular portion 310 by a material formed in a flat shape, a U shape, or the like being formed into a tubular shape so as to wrap around the conductor 210 is also included. The tubular portion 310 is crimped to the end portion 211 of the conductor 210 by applying a physical pressure to the end portion 211 of the conductor 210 using, for example, a crimp tool, a crimp machine, or the like. In this manner, the tubular portion 310 and the end portion 211 of the conductor 210 are physically and electrically connected to each other.

The plate portion 320 is provided integrally with the tubular portion 310. The plate portion 320 extends in a plate shape in an axial direction of the tubular portion 310 from an end of the tubular portion 310 in a radial direction of the tubular portion 310. The plate portion 320 has a through-hole 320*a*. The through-hole 320*a* passes through the plate portion 320 in a thickness direction of the plate portion 320. A fixing member 500 such as a screw or a bolt is caused to pass through the through-hole 320*a*. The fixing member 500 includes a head portion 510 and an axis portion 520. The axis portion 520 is thinner than the head portion 510 and has a screw thread formed thereon.

The terminal base 400 includes, for example, a terminal base main body 410 and a terminal base cover 420. The terminal base main body 410 includes an insulating base 411 and a plurality of electrical connection portions (terminal base terminal portions) 412 provided at the base 411. The base 411 includes standing walls 411*a* between the plurality of electrical connection portions 412.

Each electrical connection portion 412 includes a metal component 412*a* to which the plate portion 320 of the crimp terminal 300 is connected. The electrical connection portion 412 has screw holes 412*b* that face the through-holes 320*a* of the crimp terminals 300. The screw hole 412*b* may be provided at the metal component 412*a*, or in a case in which a receiver that is different from the metal component 412*a* is provided on the back side of the metal component 412*a*, the screw hole 412*b* may be provided at the receiver. The fixing member 500 that is caused to pass through the through-hole 320*a* of the crimp terminal 300 is engaged with the screw hole 412*b* of the electrical connection portion 412. In this manner, the plate portion 320 of the crimp terminal 300 and the electrical connection portion 412 are physically and electrically connected to each other.

The terminal base cover 420 is formed in a plate shape that covers the plurality of electrical connection portions 412, for example. The terminal base cover 420 is formed from an insulating material such as a synthetic resin. The terminal base cover 420 covers the plate portions 320 of the crimp terminals 300 on the side opposite to the electrical connection portions 412. In the electrical connection structure 10, a part of the plate portion 320 of the crimp terminal 300 and the tubular portion 310 are located outside the terminal base 400, for example. The part of the plate portion 320 of the crimp terminal 300 and the tubular portion 310 are not covered with the terminal base cover 420.

Figure 2:
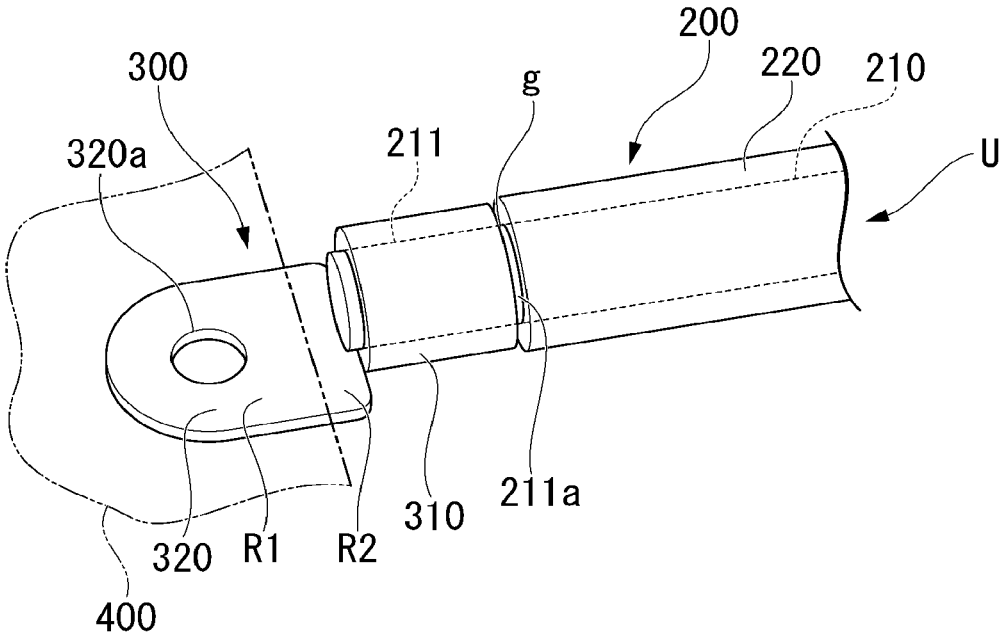
FIG. 2 is a perspective view illustrating an example of an electrical wire unit for explaining the first embodiment.

FIG. 2 is a perspective view illustrating an example of the electrical wire unit U. In the example illustrated in FIG. 2, a gap g is present in the axial direction of the tubular portion 310 between the tubular portion 310 of the crimp terminal 300 and the insulator 220 of the electrical wire 200. The end portion 211 of the conductor 210 of the electrical wire 200 includes an exposed portion 211*a* that is exposed to the gap g between the tubular portion 310 and the insulator 220. The gap g may be formed by attaching the crimp terminal 300 to the conductor 210 of the electrical wire 200 with a gap g intentionally provided therebetween, may be formed as a result in the process of bending or mounting the electrical wire 200, may be formed by applying an external force to the insulator 220 and thus causing the insulator 220 to deviate (retreat) with respect to the conductor 210 such that the gap g is generated therebetween, or may be formed by other methods.

The plate portion 320 of the crimp terminal 300 includes a first region R1 that faces the terminal base 400 and a second region R2 that projects to the outside of the terminal base 400.

Figure 3:
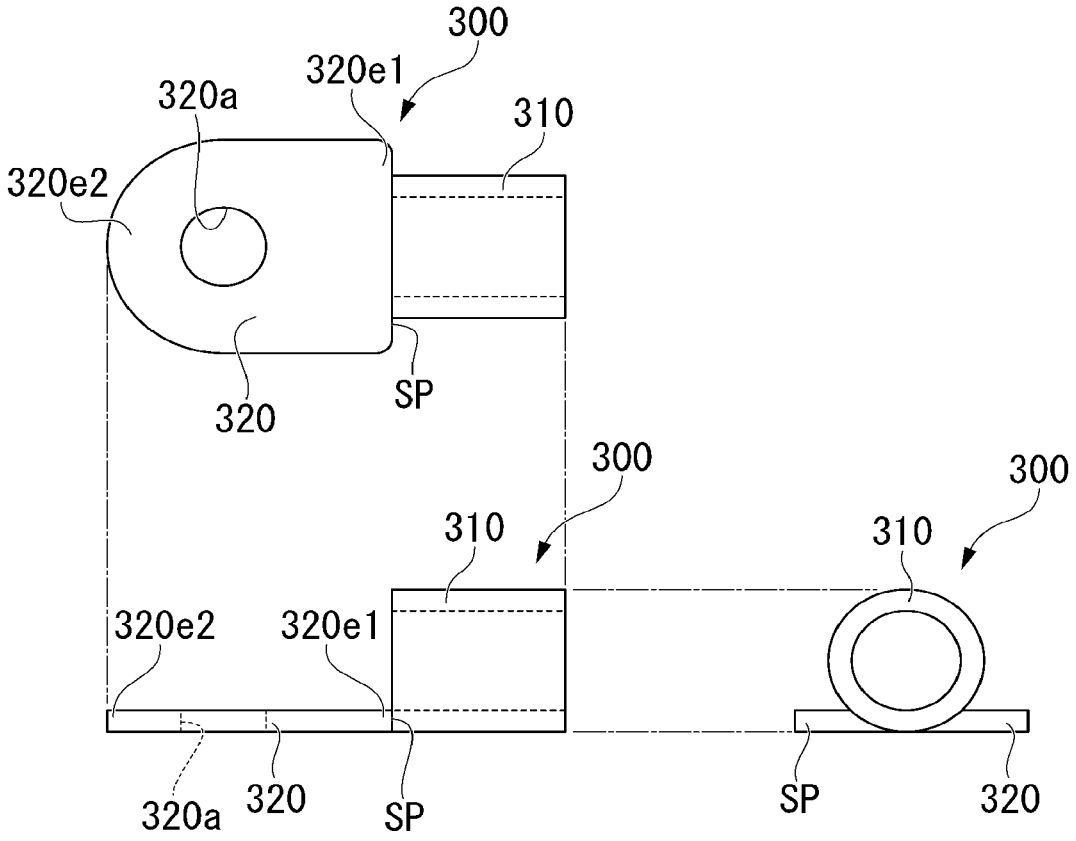
FIG. 3 is a diagram illustrating an example of a crimp terminal for explaining the first embodiment.

FIG. 3 is a diagram illustrating an example of the crimp terminal 300. The crimp terminal 300 is a crimp terminal through which a relatively large current flows, for example, and has a shape as follows in order to secure a large contact area with respect to the electrical connection portion 412 of the terminal base 400. That is, the plate portion 320 of the crimp terminal 300 includes a first end portion 320*e*1 and a second end 320*e*2 located on the side opposite to the first end portion 320*e*1. The first end portion 320*e*1 is an end connected to the tubular portion 310. The first end portion 320*e*1 includes a straight portion SP that linearly extends on both sides of the tubular portion 310 in the width direction of the crimp terminal 300. However, the shape of the crimp terminal 300 is not limited to the aforementioned example.

Next, the insulating cover 100 according to the embodiment will be described.

Figure 4:
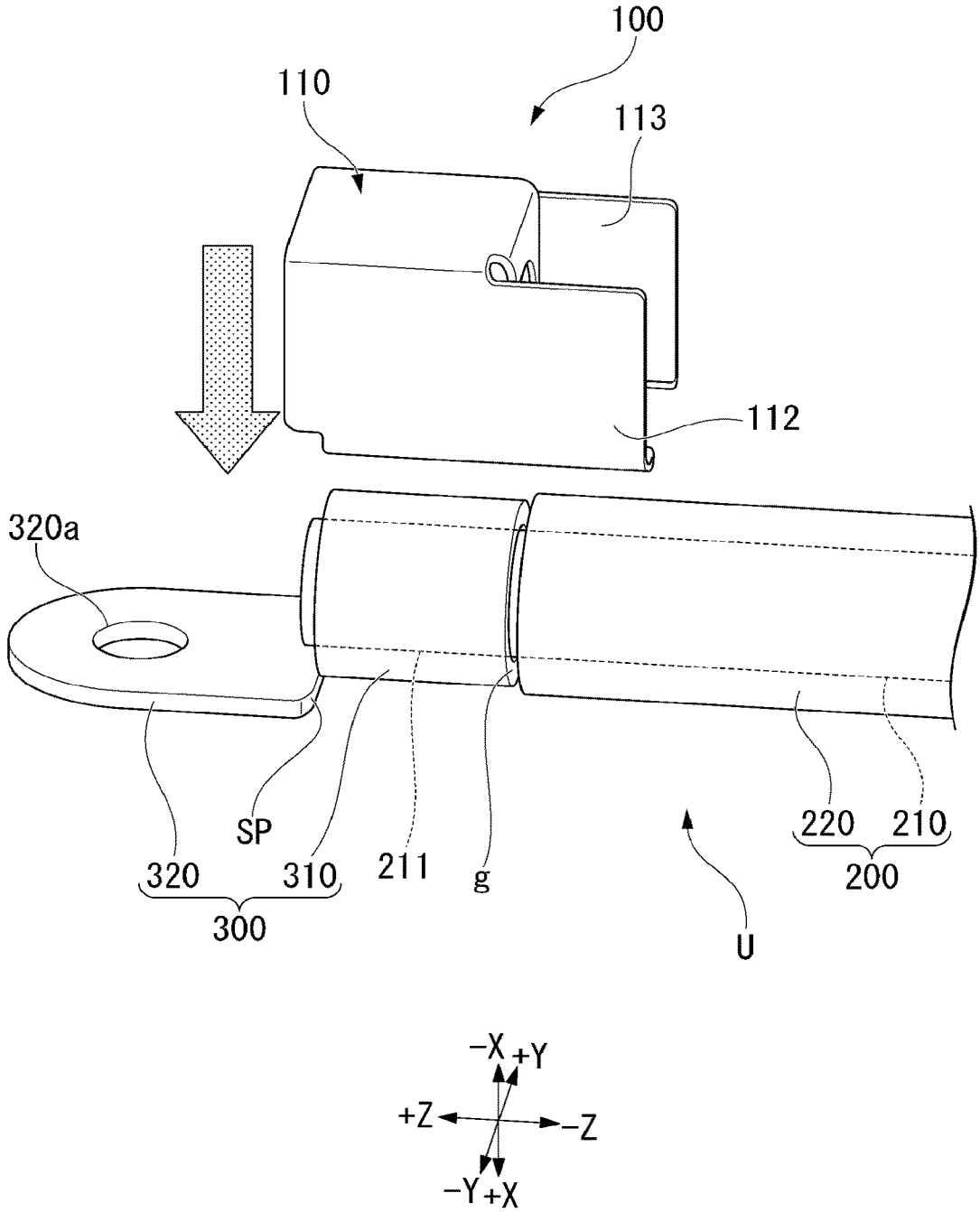
FIG. 4 is a perspective view illustrating the electrical wire unit and an insulating cover according to the first embodiment.

FIG. 4 is a perspective view illustrating the electrical wire unit U and the insulating cover 100. The insulating cover 100 is formed from an insulating material such as a synthetic resin. Although a material of the insulating cover 100 is polycarbonate in one example, the material is not limited thereto. The insulating cover 100 is disposed outside the terminal base 400 and does not cover a greater part of the plate portion 320 of the crimp terminal 300. The insulating cover 100 covers the tubular portion 310 of the crimp terminal 300.

Here, a +X direction, −X direction, +Y direction, −Y direction, +Z direction, and −Z direction will be defined for convenience of explanation. The +X direction is a direction in which the insulating cover 100 is attached to the electrical wire unit U and is, for example, a direction that is substantially perpendicular to the plate portion 320 of the crimp terminal 300. The +X direction is a direction along the radial direction of the tubular portion 310 of the crimp terminal 300. The −X direction is a direction opposite to the +X direction. In a case in which the +X direction and the −X direction are not distinguished from each other, the directions will simply be referred to as an "X direction". The +Y direction and the −Y direction are directions that are different from (for example, substantially perpendicular to) the X direction. The +Y direction is a direction from a second cover portion 112 toward a third cover portion 113 of a cover main body 110, which will be described later. The −Y direction is a direction opposite to the +Y direction. In a case in which the +Y direction and the −Y direction are not distinguished from each other, the directions will simply be referred to as a "Y direction". The +Z direction and the −Z direction are directions that are different from (for example, substantially perpendicular to) the X direction and the Y direction and are directions along the axial direction of the tubular portion 310. The +Z direction is a direction from the insulator 220 of the electrical wire 200 toward the tubular portion 310 of the crimp terminal 300. The −Z direction is a direction opposite to the +Z direction. In a case in which the +Z direction and the −Z direction are not distinguished from each other, the directions will simply be referred to as a "Z direction". In the embodiment, the +X direction is an example of a "first direction". The +Z direction is an example of a "second direction". The −Z direction is an example of a "third direction".

Figure 5:
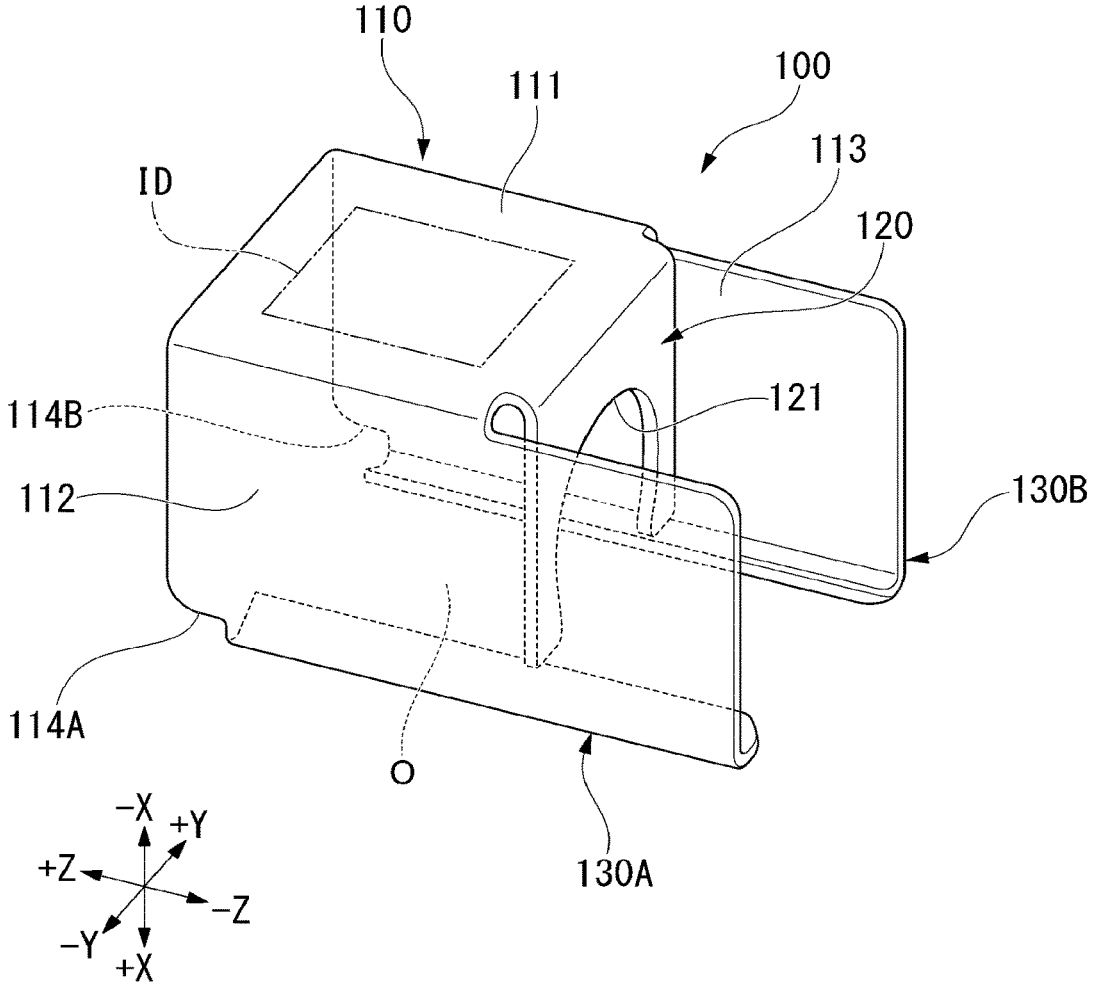
FIG. 5 is a perspective view illustrating the insulating cover according to the first embodiment.

FIG. 5 is a perspective view illustrating the insulator 100. The insulator 100 includes, for example, the cover main body 110, an engagement portion 120, and a pair of supporters 130A and 130B.

First, the cover main body 110 will be described. The cover main body 110 is open in at least one direction (for example, the +X direction) along the radial direction of the tubular portion 310 of the crimp terminal 300. The cover main body 110 is disposed outside the terminal base 400, does not cover at least a region, which faces the electrical connection portion 412 of the terminal base 400, of the plate portion 320 of the crimp terminal 300, and covers the tubular portion 310 of the crimp terminal 300. The cover main body 110 has, for example, a first cover portion 111, the second cover portion 112, the third cover portion 113, and cut-off portions 114A and 114B. The cut-off portions 114A and 114B will be described later.

The first cover portion 111 is formed in a plate shape along the Y direction and the Z direction. The first cover portion 111 covers the tubular portion 310 of the crimp terminal 300 in the +X direction. The first cover portion 111 does not cover the first region R1 of the plate portion 320 of the crimp terminal 300 and covers at least a part of the second region R2 of the plate portion 320 in the +X direction.

The second cover portion 112 extends in the +X direction from the end of the first cover portion 111 on the −Y direction side. The second cover portion 112 is formed into a plate shape along the X direction and the Z direction. The second cover portion 112 covers the tubular portion 310 of the crimp terminal 300 in the +Y direction. In the embodiment, the second cover portion 112 extends further on the −Z direction side beyond the end of the first cover portion 111 on the −Z direction side.

The third cover portion 113 extends in the +X direction from the end of the first cover portion 111 on the +Y direction side. The third cover portion 113 is formed in a plate shape along the X direction and the Z direction. The third cover portion 113 covers the tubular portion 310 of the crimp terminal 300 in the −Y direction. That is, the cover main body 110 surrounds the tubular portion 310 of the crimp terminal 300 in three directions with the first to third cover portions 111, 112, and 113. The cover main body 110 has an open portion O that opens to the outside in the +X direction. The open portion O is formed between the end of the second cover portion 112 on the +X direction side and the end of the third cover portion 113 on the +X direction side. In the embodiment, the third cover portion 113 extends further on the side of the −Z direction beyond the end of the first cover portion 111 on the −Z direction side.

The insulating cover 100 may be provided with an identification display ID. The identification display ID may indicate a line number of the electrical wire 200 to which the insulating cover 100 is attached or may indicate a phase (a U phase, a V phase, or a W phase) of an AC power supplied to the electrical wire 200 to which the insulating cover 100 is attached. The identification display ID may be formed from irregularities provided on the surface of the insulating cover 100 or may be formed of display of a sticker or the like attached to the insulating cover 100. Also, the identification display ID may include not only characters but also include only a single color or two or more colors. For example, the identification display ID may include different colors for the respective phases (a U phase, a V phase, and a W phase) of AD power. The identification display ID may be provided at two or more of the first cover portion 111, the second cover portion 112, and the third cover portion 113.

Next, the engagement portion 120 will be described. The engagement portion 120 extends in the +X direction from the end of the first cover portion 111 on the −Z direction side. The engagement portion 120 is formed into a plate shape along the X direction and the Y direction. The engagement portion 120 includes an arc portion 121 along an outer shape (outer circumferential surface) of the conductor 210 of the electrical wire 200. The arc portion 121 is engaged with a region, which is not covered with the tubular portion 310 of the crimp terminal 300, at the end portion 211 of the conductor 210 in the +X direction. "Engagement" described in the specification widely means "in a relation". That is, "engagement" not only means a case in which a secured state occurs between two members that are engaged with each other but also includes a case in which the two members are just in contact with each other.

In the embodiment, the engagement portion 120 is inserted between the gap g between the tubular portion 310 of the crimp terminal 300 and the insulator 220 of the electrical wire 200 and is engaged with the exposed portion 211*a* that is exposed to the gap g at the end portion 211 of the conductor 210 (see FIG. 4). In the case in which the engagement portion 120 is inserted between the tubular portion 310 of the crimp terminal 300 and the insulator 220 of the electrical wire 200, the engagement portion 120 faces the tubular portion 310 of the crimp terminal 300 in the +Z direction and faces the insulator 220 of the electrical wire 200 in the −Z direction. In this manner, the position of the engagement portion 120 in the +Z direction (the position of the insulating cover 100 in the +Z direction) is restricted by the tubular portion 310 of the crimp terminal 300. Meanwhile, the position of the engagement portion 120 in the −Z direction (the position of the insulating cover 100 in the −Z direction) is restricted by the insulator 220 of the electrical wire 200. For example, the engagement portion 120 is in contact with both the tubular portion 310 of the crimp terminal 300 and the insulator 220 of the electrical wire 200 and is pinched with the tubular portion 310 and the insulator 220. The engagement portion 120 may be in contact with either the tubular portion 310 or the insulator 220 in a case in which the gap g is greater than the thickness of the engagement portion 210, for example.

Figure 6:
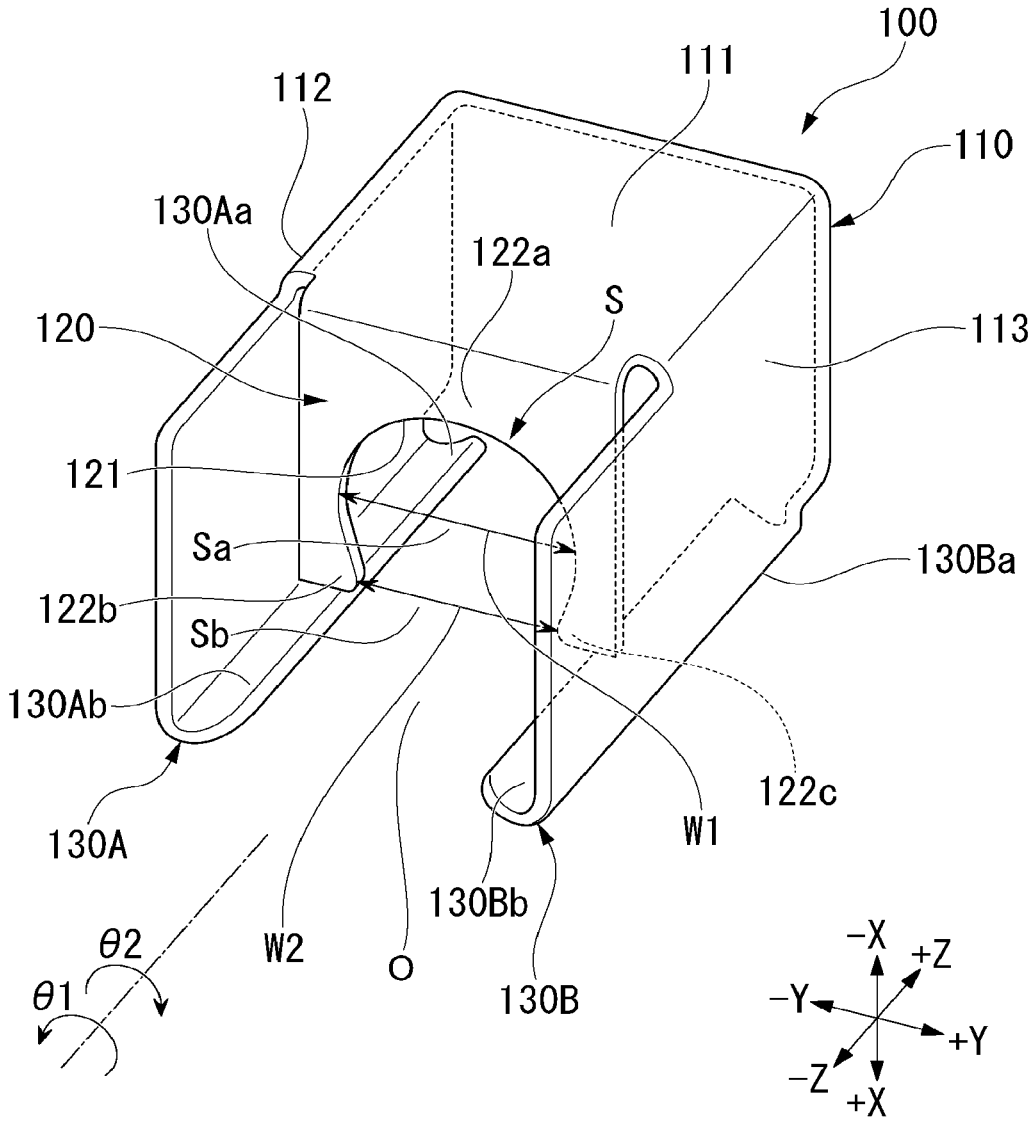
FIG. 6 is a perspective view illustrating the insulating cover according to the first embodiment.

FIG. 6 is a perspective view of the insulating cover 100 when seen at another angle. In the embodiment, the arc portion 121 of the engagement portion 120 is formed at an angle that is greater than 180 degrees and defines a space S, into which the conductor 210 of the electrical wire 200 is inserted, inside the engagement portion 120. The space S is open on the +X direction side. The space S has a central portion Sa located at the center of the space S and an inlet portion Sb located on the +X direction side with respect to the central portion Sa. The width W2 of the inlet portion Sb in the Y direction is narrower than the width W1 of the central portion Sa in the Y direction. In this manner, the engagement portion 120 is formed in a U hole shape with a narrow entrance.

In the embodiment, the width W1 of the central portion Sa in the Y direction is substantially the same as the diameter of the conductor 210 of the electrical wire 200. Meanwhile, the width W2 of the inlet portion Sb in the Y direction is smaller than the diameter of the conductor 210 of the electrical wire 200. The engagement portion 120 is elastically deformed such that the conductor 210 of the electrical wire 200 is able to pass therethrough in a case in which the conductor 210 of the electrical wire 200 is pressed against the engagement portion 120. In this manner, the conductor 210 of the electrical wire 200 passes through the inlet portion Sb and is then inserted into the central portion Sa of the space S. The conductor 210 of the electrical wire 200 inserted into the central portion Sa of the space S is not easily pulled out of the space S sine the width of the inlet portion Sb is narrower than the diameter of the conductor 210. In a case in which the conductor (inner conductor) 210 of the electrical wire 200 is a stranded wire, the conductor 210 can be elastically deformed in a direction in which the conductor 210 becomes thinner or thicker by the positions of a plurality of wires W consisting of the stranded wire deviating from one another. Therefore, in a case in which the conductor 210 of the electrical wire 200 is pressed against the engagement portion 120, the positions of the plurality of wires W consisting of the stranded wire deviate from one another, and the conductor 210 thus becomes thinner than the inlet portion Sb. In this manner, the conductor 210 of the electrical wire 200 may pass through the inlet portion Sb and be inserted into the central portion Sa of the space S. In this case, the conductor 210 is returned into an original shape by the conductor 210 reaching the central portion Sa of the space S, and the conductor 210 is thus not easily pulled out of the space S.

The above point will be described from another viewpoint. The engagement portion 120 includes a first portion 122*a*, a second portion 122*b*, and a third portion 122*c*. The first portion 122*a* faces the conductor 210 of the electrical wire 200 in the +X direction. The second portion 122*b* faces the conductor 210 of the electrical wire 200 at a position that is different greater than 90 degrees in a first circumferential direction θ1 with respect to the first portion 122*a*. The first circumferential direction θ1 is a direction along the outer shape (outer circumferential surface) of the conductor 210. Meanwhile, the third portion 122*c* faces the conductor 210 of the electrical wire 200 at a position that is different greater than 90 degrees in a second circumferential direction θ2 with respect to the first portion 122*a*. The second circumferential direction θ2 is a direction along the outer shape (outer circumferential surface) of the conductor 210 and is a direction opposite to the first circumferential direction θ1. A gap between the second portion 122*b* and the third portion 122*c* defines the inlet portion Sb of the space S.

Each of the second portion 122*b* and the third portion 122*c* are a support portion that supports the conductor 210 of the electrical wire 200 inserted into the central portion Sa of the space S in a direction different from that of the first portion 122*a*. "Support" in the specification is not limited to a case in which the member is constantly in contact with a target to support the target but includes a case in which a gap is present between the member and the target and the member is brought into contact with the target and supports the target (restricts the position, for example) in a case in which an external force acts and the target moves (is inclined, for example), for example.

In the embodiment, the engagement portion 120 is not connected to the second cover portion 112 and the third cover portion 113 of the cover main body 110. Therefore, elastic deformation of the engagement portion 120 is not restricted by the second cover portion 112 and the third cover portion 113. Therefore, the engagement portion 120 can be elastically deformed in a relatively free manner such that the conductor 210 of the electrical wire 200 can pass through the inlet portion Sb.

Next, the pair of supporters 130A and 130B (the first support portion 130A and the second support portion 130B) will be described. The first support portion 130A is provided at the end of the second cover portion 112 on the +X direction side. The first support portion 130A is formed by bending the end of the second cover portion 112 on the +X direction side toward the inside of the insulating cover 100, for example. The first support portion 130A faces the electrical wire 200 and the tubular portion 310 of the crimp terminal 300 on the side opposite to at least a part (for example, the first cover portion 111) of the cover main body 110.

In the embodiment, the first support portion 130A is provided over the entire length of the second cover portion 112 in the Z direction. The first support portion 130A includes a first portion 130Aa located on the +Z direction side beyond the engagement portion 120 and a second portion 130Ab located on the −Z direction side beyond the engagement portion 120. The first portion 130As faces the tubular portion 310 of the crimp terminal 300 on the side opposite to the first cover portion 111. The second portion 130Ab faces the insulator 220 of the electrical wire 200 on the side opposite to the first cover portion 111. In the embodiment, the outer diameter of the insulator 220 of the electrical wire 200 is greater than the outer diameter of the tubular portion 310 of the crimp terminal 300. For this reason, the second portion 130Ab is brought into contact with the insulator 220 of the electrical wire 200 and supports the electrical wire 200. In a case in which the outer diameter of the tubular portion 310 of the crimp terminal 300 is substantially the same as or greater than the outer diameter of the insulator 220 of the electrical wire 200, the first portion 130Aa may be brought into contact with the tubular portion 310 of the crimp terminal 300 and support the tubular portion 310 of the crimp terminal 300. The first support portion 130A may have only either the first portion 130Aa or the second portion 130Ab. In other words, the first support portion 130A may support at least one of the electrical wire 200 and the tubular portion 310 of the crimp terminal 300.

The second support portion 130B is provided at the end of the third cover portion 113 on the +X direction side. The second support portion 130B is formed by bending the end of the third cover portion 113 on the +X direction side toward the inside of the insulating cover 100, for example. The second support portion 130B faces the electrical wire 200 and the tubular portion 310 of the crimp terminal 300 on the side opposite to at least a part (for example, the first cover portion 111) of the cover main body 110.

In the embodiment, the second support portion 130B is provided over the entire length of the third cover portion 113 in the Z direction. The second support portion 130B includes a first portion 130Ba located on the +Z direction side beyond the engagement portion 120 and a second portion 130Bb located on the −Z direction side beyond the engagement portion 120. The first portion 130Ba faces the tubular portion 310 of the crimp terminal 300 on the side opposite to the first cover portion 111. The second portion 130Bb faces the insulator 220 of the electrical wire 200 on the side opposite to the first cover portion 111. In the embodiment, the second portion 130Bb is brought into contact with the insulator 220 of the electrical wire 200 and supports the electrical wire 200. In a case in which the outer diameter of the tubular portion 310 of the crimp terminal 300 is substantially the same as or greater than the outer diameter of the insulator 220 of the electrical wire 200, the first portion 130Ba may be brought into contact with the tubular portion 310 of the crimp terminal 300 and support the tubular portion 310 of the crimp terminal 300. The first support portion 130B may have only either the first portion 130Ba or the second portion 130Bb. In other words, the second support portion 130B may support at least one of the electrical wire 200 and the tubular portion 310 of the crimp terminal 300.

Figure 7:
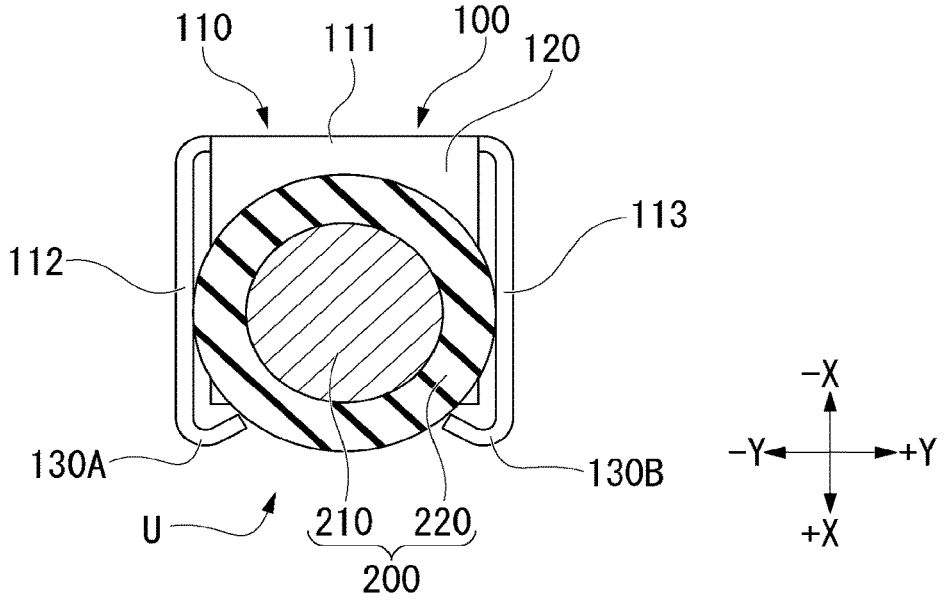
FIG. 7 is a sectional view illustrating the electrical wire unit and the insulating cover according to the first embodiment.

FIG. 7 is a sectional view illustrating the electrical wire unit U and the insulating cover 100. The first support portion 130A is located on the side opposite to the engagement portion 120 with respect to a part of the electrical wire 200 and supports the insulator 220 of the electrical wire 200 on the side opposite to the engagement portion 120. Similarly, the second support portion 130B is located on the side opposite to the engagement portion 120 with respect to a part of the electrical wire 200 and supports the insulator 220 of the electrical wire 200 on the side opposite to the engagement portion 120. In this manner, the position of the electrical wire 200 is restricted between the engagement portion 120 and the pair of supporters 130A and 130B. In this manner, the insulting cover 100 does not easily fall off from the electrical wire unit U.

Figure 8:
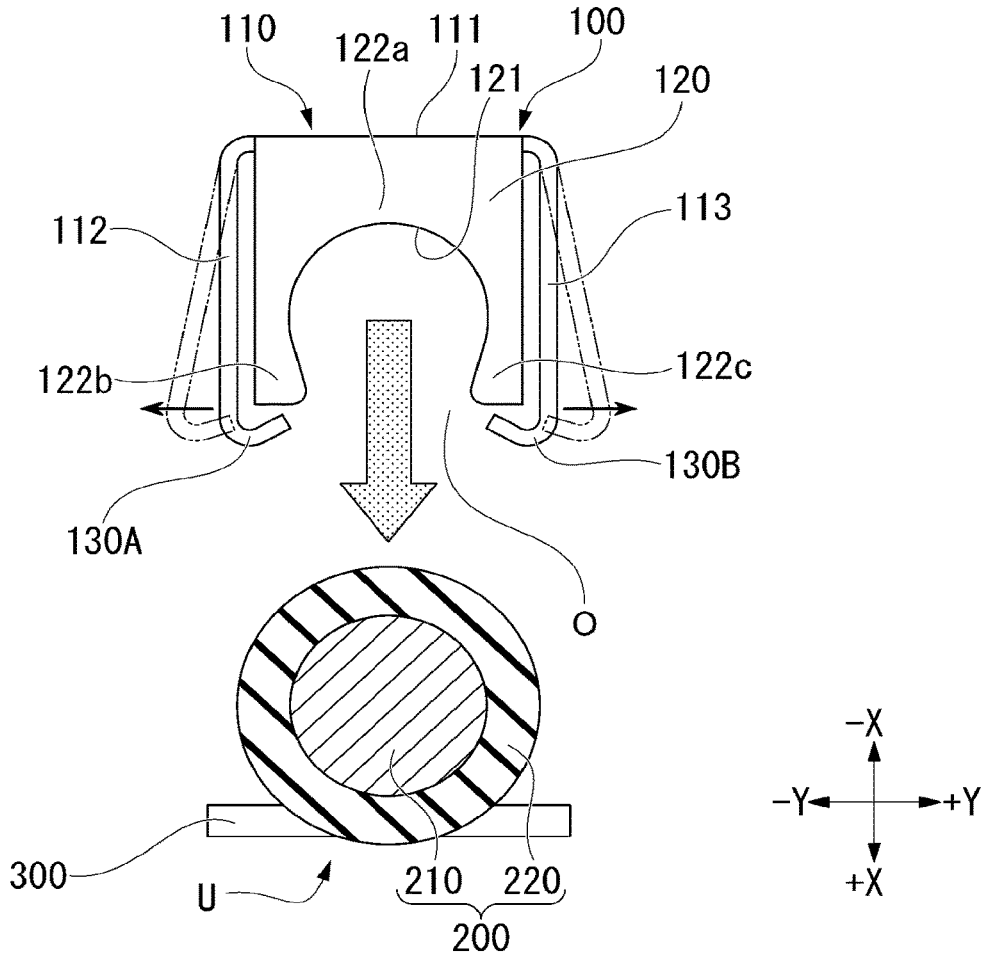
FIG. 8 is a sectional view illustrating a method for attaching the insulating cover to the electrical wire unit according to the first embodiment.

FIG. 8 is a sectional view illustrating a method for attaching the insulating cover 100 to the electrical wire unit U. The insulating cover 100 can be elastically deformed such that the first support portion 130A and the second support portion 130B are separated from each other. For example, the first support portion 130A and the second support portion 130B can move in a direction in which the first support portion 130A and the second support portion 130B are separated from each other by elastically deforming the second cover portion 112 and the third cover portion 113 with respect to the first cover portion 111. In this manner, it is possible to insert the electrical wire unit U into the inside of the insulating cover 100.

Here, the second cover portion 112 and the third cover portion 113 are not connected to the engagement portion 120 in the embodiment. Therefore, elastic deformation of the second cover portion 112 and the third cover portion 113 is not restricted by the engagement portion 120. Therefore, the second cover portion 112 and the third cover portion 113 can be elastically deformed in a relatively free manner such that the electrical wire unit U is caused to pass between the first support portion 130A and the second support portion 130B.

Figure 9:
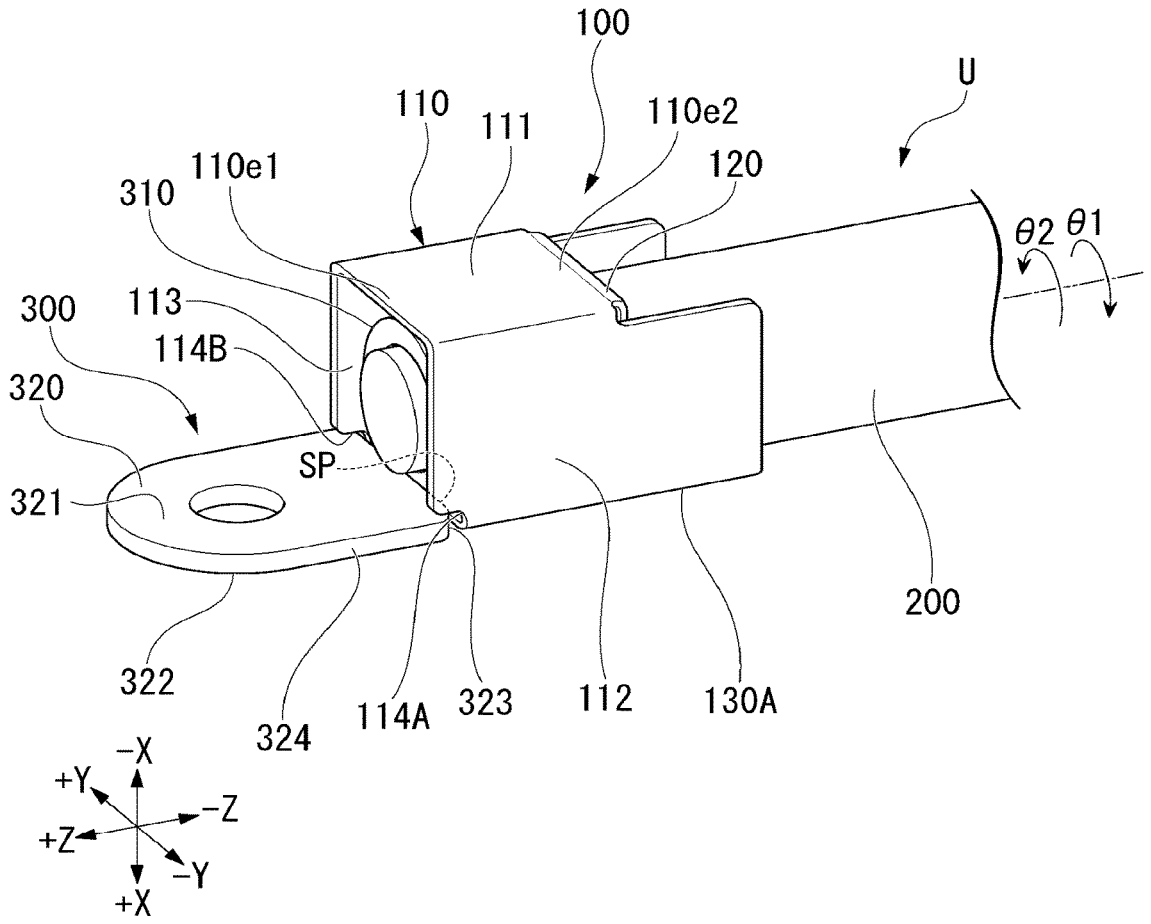
FIG. 9 is a perspective view illustrating the electrical wire unit and the insulating cover according to the first embodiment.

Next, the cut-off portions 114A and 114B of the cover main body 110 will be described. FIG. 9 is a perspective view illustrating the electrical wire unit U and the insulating cover 100. In the embodiment, the cover main body 110 includes a first end portion 110*e*1 and a second end 110*e*2. The first end portion 110*e*1 is an end on the +Z direction side. The first end portion 110*e*1 is an end located on the side opposite to the engagement portion 120 with respect to the first cover portion 111 in the Z direction. The second end 110*e*2 is an end on the −Z direction side and is located on the side opposite to the first end portion 110*e*1.

Here, the plate portion 320 of the crimp terminal 300 has a first main surface 321, a second main surface 322, an end surface 323, and side surfaces 324. The first main surface 321 and the second main surface 322 are surfaces along the Y direction and the Z direction. Each of the first main surface 321 and the second main surface 322 is a surface with the largest area among the surfaces of the plate portion 320. The first main surface 321 is directed in the −X direction. The first main surface 321 faces the head portion 510 of the fixing member 500 that is caused to pass through the through-hole 320*a* of the plate portion 320. The second main surface 322 is located on the side opposite to the first main surface 321 and is directed in the +X direction. The end surface 323 is a surface located at the end of the plate portion 320 on the −Z direction side and along the X direction and the Y direction. The end surface 323 connects the first main surface 321 to the second main surface 322. The end surface 323 defines the aforementioned straight portion SP. The side surface 324 is a surface directed in the +Y direction or the −Y direction among circumferential surfaces of the plate portion 320. The side surface 324 substantially perpendicularly intersects with the first main surface 321 and connects the first main surface 321 to the second main surface 322.

In the embodiment, a part of the first end portion 110*e*1 of the cover main body 110 projects on the +X direction side beyond the first main surface 321 of the plate portion 320 and faces the end surface 323 (that is, the straight portion SP) of the plate portion 320 in the +Z direction. In this manner, the position of the first end portion 110*e*1 of the cover main body 110 in the +Z direction (the position of the insulating cover 100 in the +Z direction) is restricted by the plate portion 320 of the crimp terminal 300. In the embodiment, the first end portion 110*e*1 of the cover main body 110 faces the straight portion SP of the plate portion 320 in the +Z direction. In this manner, the position of the first end portion 110*e*1 of the cover main body 110 is more stably restricted.

In the embodiment, the pair of cut-off portions 114A and 114B (the first cut-off portion 114A and the second cut-off portion 114B) are provided at the first end portion 110*e*1 of the cover main body 110. The first cut-off portion 114A is formed by cutting-off the end of the second cover portion 112 on the +X direction side and the first support portion 130A. In other words, the first cut-off portion 114A is provided over the second cover portion 112 and the first support portion 130A. The first cut-off portion 114A is engaged with the plate portion 320 (for example, the straight portion SP of the plate portion 320) in the +Z direction and the +X direction. In this manner, the position of the insulating cover 100 in the +X direction (for example, the position of the second cover portion 112 in the +X direction) in addition to the position of the insulating cover 100 in the +Z direction is restricted by the plate portion 320 of the crimp terminal 300. "Engaged" in the specification is not limited to a case in which the member is constantly in contact with a target but also includes a case in which a gap from the target is present and also the member is brought into contact with the target and is engaged with the target when an external force acts and the target thus moves (for example, the position thereof deviates), for example. In a case in which at least a part of another member is located in a space defined by the cut-off portion (the space surrounded in at least two directions by the cut-off portion), for example, the member is "engaged" in this specification.

Meanwhile, the second cut-off portion 114B is formed by cutting-off the end of the third cover portion 113 on the +X direction side and the second support portion 130B. In other words, the second cut-off portion 114B is provided over the third cover portion 113 and the second support portion 130B. The second cut-off portion 114B is engaged with the plate portion 320 (for example, the straight portion SP of the plate portion 320) in the +Z direction and the +X direction. In this manner, the position of the insulating cover 100 in the +X direction (for example, the position of the third cover portion 113 in the +X direction) in addition to the position of the insulating cover 100 in the +Z direction is restricted by the plate portion 320 of the crimp terminal 300. In the embodiment, rotation of the insulating cover 100 in the circumferential direction (the first circumferential direction θ1 and the second circumferential direction θ2) of the electrical wire 200 is restricted by each of the first and second cut-off portion s 114A and 114B being engaged with the plate portion 320.

Next, a method for attaching the insulating cover 100 will be described. First, the end portion 211 of the conductor 210 of the electrical wire 200 is inserted into the tubular portion 310 of the crimp terminal 300. Then, the tubular portion 310 of the crimp terminal 300 is crimped at the end portion 211 of the conductor 210 of the electrical wire 200 using a crimp tool, a crimp machine, or the like. In this manner, the electrical wire unit U including the electrical wire 200 and the crimp terminal 300 is provided.

The insulating cover 100 is attached to the electrical wire unit U before the electrical wire unit U is attached to the terminal base 400, for example. Specifically, the insulating cover 100 is caused to be elastically deformed such that the first support portion 130A and the second support portion 130B are separated from each other, and the insulating cover 100 is attached to the electrical wire unit U in the +X direction. At this time, the conductor 210 of the electrical wire 200 passes through the inlet portion Sb of the space S and is inserted into the central portion Sa of the space S by the conductor 210 of the electrical wire 200 being pressed against the engagement portion 120 and the engagement portion 120 being elastically deformed. In a case in which the conductor (inner conductor) 210 of the electrical wire 200 is a stranded wire, the conductor 210 of the electrical wire 200 may pass through the inlet portion Sb of the space S and be inserted into the central portion Sa of the space S by the conductor 210 being pressed against the engagement portion 120, the positions of the plurality of wires W included in the stranded wire deviating from one another, the conductor 210 becoming thinner than the inlet portion Sb. In this manner, the electrical wire 200 is supported by the first support portion 130A, the second support portion 130B, and the engagement portion 120 in a plurality of directions, and the insulating cover 100 is thus not easily detached from the electrical wire unit U.

Also, the engagement portion 120 of the insulating cover 100 is inserted between the tubular portion 310 of the crimp terminal 300 and the insulator 220 of the electrical wire 200, and the cut-off portions 114A and 114B of the cover main body 110 are engaged with the plate portion 320 of the crimp terminal 300 in the embodiment. In this manner, positional deviation or rotation of the insulating cover 100 in the +Z direction, the −Z direction, the first circumferential direction θ1, and the second circumferential direction θ2 are restricted.

After the insulating cover 100 is attached to the electrical wire unit U, the electrical wire unit U is attached to the terminal base main body 410. In addition, the terminal base cover 420 is attached to the terminal base main body 410. In this manner, the plate portion 320 of the crimp terminal 300 is covered with the terminal base cover 420, and insulating properties are enhanced.

In addition, the method for attaching the insulating cover 100 is not limited to the aforementioned example. For example, the electrical wire unit U may be attached to the terminal base main body 410 before the insulating cover 100 is attached. In this case, the insulating cover 100 is attached to the electrical wire unit U after the electrical wire unit U is attached to the terminal base main body 410.

Next, effects of the insulating cover 100 will be described. The insulating cover 100 is disposed outside the terminal base 400 and covers the tubular portion 310 of the crimp terminal 300 that is not covered with the terminal base cover 420. In this manner, insulating properties of the tubular portion 310 of the crimp terminal 300 are enhanced.

Figure 10:
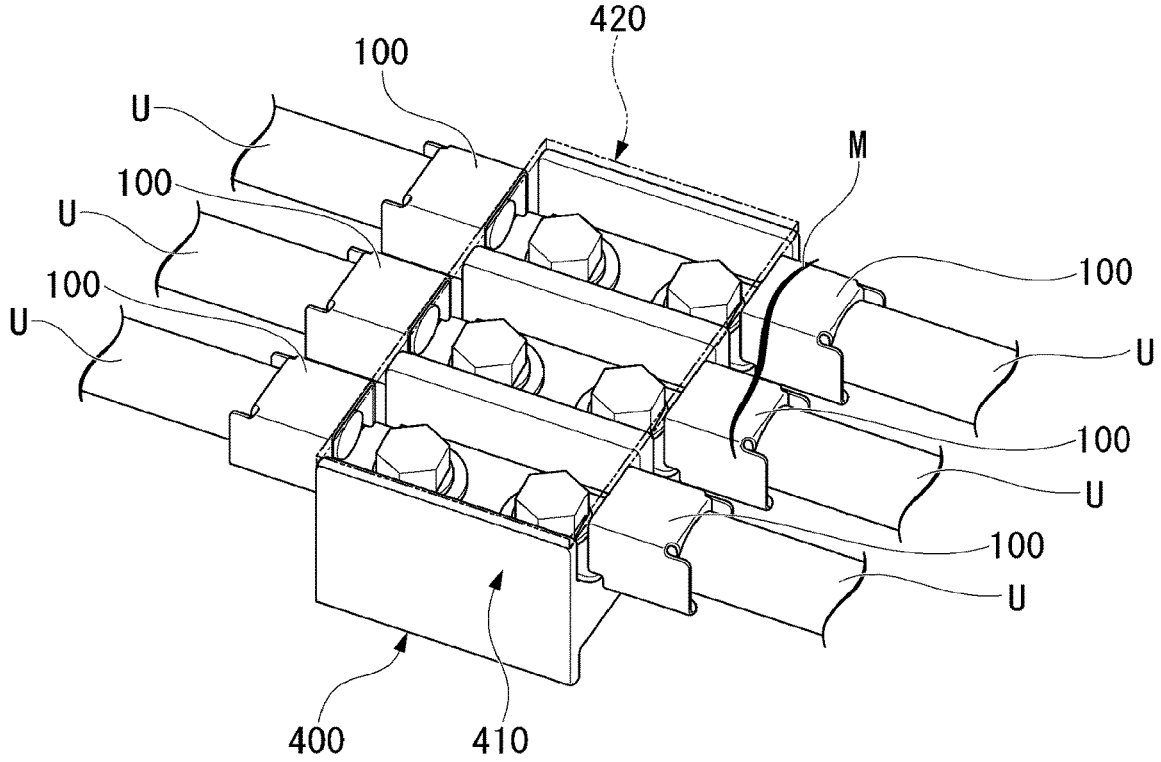
FIG. 10 is a perspective view illustrating a terminal base, a plurality of electrical wire units, and a plurality of insulating covers according to the first embodiment.

FIG. 10 is a perspective view illustrating the terminal base 400, the plurality of electrical wire units U, and the plurality of insulating covers 100. In the configuration illustrated in FIG. 10, the plurality of electrical wire units U are attached to the single terminal base 400. In addition, the insulating cover 100 is attached to each of the electrical wire units U. With such a configuration, insulating properties among the tubular portions 310 of the plurality of crimp terminals 300 are secured, and short-circuiting is prevented even in a case in which a conductive foreign matter M (for example, a facet) is brought into contact with the tubular portions 310 of the plurality of crimp terminals 300.

With such a configuration, it is possible to provide the insulating cover 100 which has a high versatility and which is capable of undergoing retrofit or replacement. Hereinafter, details thereof will be described. In the related art, crimp terminals provided with insulating sheaths are used, or tubular insulating caps are attached in order to insulate the tubular portions 310 of the crimp terminals 300.

The crimp terminals provided with the insulating sheaths are divided into types depending on sizes of screws of the crimp terminals in addition to sizes of the electrical wires. Therefore, it is necessary to have a large number of inventories in a case in which the crimp terminals provided with the insulating sheaths are used. Also, it is difficult to perform retrofit or replacement of the crimp terminals provided with the insulating sheaths, and it is necessary to cut the electrical wire 200 for replacement. The "retrofit" described in the specification means that a component for insulation is attached after the crimp terminal 300 is attached to the electrical wire 200. Also, it is difficult to reuse the crimp terminal provided with the insulating sheath once the crimp terminal is attached. Further, the sizes of the crimp terminals provided with the insulating sheaths are typically up to a predetermined size (for example, 5.5 $mm^2$), and it is difficult to apply the crimp terminals provided with the insulating sheaths to thick wires.

Also, since it is necessary to cause the electrical wire 200 to pass through a tubular insulating cap before the crimp terminal 300 is connected to the electrical wire 200, it is difficult to perform retrofit and replacement, and it is typically necessary to cut the electrical wire 200 for replacement. Further, since the tubular insulating cap is adapted such that the electrical wire 200 is just caused to pass therethrough, the position of the tubular insulating cap is not fixed. Therefore, there is a probability that the position of the insulting cap may deviate at the time of transport or device maintenance. If the position of the insulating cap deviates, the tubular portion of the crimp terminal may be exposed, or a part of the insulating cap may enter between the terminal base and the crimp terminal, which may lead to connection failure. Therefore, it is necessary to take an additional countermeasure, such as fixing of a part of the insulating cap to the terminal base, in many cases in order for the positions of the insulating caps not to deviate when the insulating caps are used.

Meanwhile, the insulating cover 100 according to the embodiment includes the cover main body 110 and the pair of supporters 130A and 130B. The cover main body 110 is open in at least one direction along the radial direction of the tubular portion 310 of the crimp terminal 300. The cover main body 110 is disposed outside the terminal base 400, does not cover at least the region, which faces the electrical connection portion 412 of the terminal base 400, in the plate portion of the crimp terminal 300, and covers the crimp terminal 300. The pair of supporters 130A and 130B face the electrical wire 200 on the side opposite to the cover main body 110.

With such a configuration, the shape of the insulating cover 100 does not depend on the shape of the plate portion 320 of the crimp terminal 300, the size of the fixing member 500, the shape of the terminal base 400, and the like. The shape of the insulating cover 100 is determined depending only on the size of the electrical wire 200, for example. Therefore, it is possible to reduce the types of insulating cover 100 as compared with a case in which a crimp terminal provided with an insulating sheath or, for example, an insulating cap that covers the plate portion 320 of the crimp terminal 300 is used. In this manner, it is possible to enhance versatility of the insulating cover 100.

In addition, since the crimp terminal 300 is open in at least one direction along the radial direction of the tubular portion 310 of the crimp terminal 300, it is possible to attach the insulating cover 100 to the electrical wire unit U through retrofit even after the crimp terminal 300 is attached to the electrical wire 200 and to replace the insulating cover 100 that has already been attached to the electrical wire unit U with another insulating cover 100 according to the insulating cover 100 in the embodiment. If the insulating cover 100 can undergo retrofit, it is possible to address problems in relation to insulation by post-attaching the insulating cover 100 without cutting or rearranging the electrical wire 200 even in a case in which such a problem occurs after a device is mounted, for example. Also, since it is not necessary to cause the electrical wire 200 to pass through the insulating cover 100 in advance unlike a tubular insulating cap, satisfactory attachment operability is also achieved. Further, it is also possible to reuse the insulating cover 100 that is once detached. In this manner, it is possible to enhance operability at the time of mounting or maintenance of the device and to reduce required costs.

In addition, the insulating cover 100 according to the embodiment is configured not to cover at least the region, which faces the electrical connection portion 412 of the terminal base 400, in the plate portion 320 of the crimp terminal 300, and it is thus possible to reduce the size thereof to be a size that is one size larger than the tubular portion 310 of the crimp terminal 300, for example, regardless of the shape and the size of the plate portion 320 of the crimp terminal 300. The insulating cover 100 with the size reduced in this manner can be applied to a location in which a plurality of electrical wire units U are disposed at a high density, for example, and it is possible to state that such an insulating cover 100 has higher versatility.

In addition, the insulating cover 100 according to the embodiment has a relatively simple configuration and is easily prepared for a thick electric wire or the like. Therefore, it is possible to secure insulation of the tubular portion 310 of the crimp terminal 300 with the insulating cover 100 even if the electrical wire 200 has a size that is greater than a predetermined size.

Also, according to the embodiment, the pair of supporters 130A and 130B that face the electrical wire 200 on the side opposite to the cover main body 110 are provided. With such a configuration, it is possible to curb the insulating cover 100 from falling off from the electrical wire unit U.

In the embodiment, the plate portion 320 of the crimp terminal 300 has the first region R1 that faces the terminal base 400 and the second region R2 that projects to the outside of the terminal base 400. The cover main body 110 covers at least a part of the second region R2 of the plate portion 320 of the crimp terminal 300. With such a configuration, it is also possible to enhance insulation regarding the second region R2 of the plate portion 320 exposed to the outside of the terminal base 400.

In the embodiment, the insulating cover 100 includes the engagement portion 120. The engagement portion 120 includes the arc portion 121 along the outer shape of the conductor 210 of the electrical wire 200 and engaged with a region, which is not covered with the tubular portion 310 of the crimp terminal 300, at the end portion 211 of the conductor 210 of the electrical wire 200 in the +X direction. That is, the engagement portion 120 for fixing the insulating cover 100 is provided using the region, which is not covered with the tubular portion 310 of the crimp terminal 300, at the end portion 211 of the conductor 210 of the electrical wire 200 by paying attention to the configuration in which there is such an uncovered region. With such a configuration, it is possible to reduce the size of the engagement portion 120 as compared with a case in which an arc-shaped engagement portion along the outer shape of the insulator 220 of the electrical wire 200 is provide since the conductor 210 is thinner than the insulator 220 of the electrical wire 200. That is, it is possible to further enhance reliability of fixing the insulating cover 100 to the electrical wire 200 and to realize size reduction of the insulating cover 100 by providing the arc-shaped engagement portion 120 that is engaged with the conductor 210 of the electrical wire 200.

In the embodiment, the engagement portion 120 is inserted between the tubular portion 310 of the crimp terminal 300 and the insulator 220 of the electrical wire 200 in the axial direction of the tubular portion 310 of the crimp terminal 300. The engagement portion 120 faces the tubular portion 310 of the crimp terminal 300 in the +Z direction and faces the insulator 220 of the electrical wire 200 in the −Z direction. With such a configuration, it is possible to reliably restrict the position of the engagement portion 120 in the Z direction with respect to the electrical wire 200. In this manner, it is possible to reduce the probability that the position of the insulating cover 100 deviates at the time of transporting or maintenance of the device, to curb the tubular portion 310 of the crimp terminal 300 from being exposed, and to curb occurrence of contact failure.

In the embodiment, the arc portion 121 of the engagement portion 120 is formed to be greater than 180 degrees and defines the space S into which the conductor 210 of the electrical wire 200 is inserted inside the engagement portion 120. The space S has the central portion Sa and the inlet portion Sb located on the +X direction side with respect to the central portion Sa. The inlet portion Sb is narrower than the central portion Sa. With such a configuration, the insulating cover 100 is further unlikely to fall off from the electrical wire 200 in a case in which the conductor 210 of the electrical wire 200 is inserted into the central portion Sa. Also, since the arc portion 121 of the engagement portion 120 is an arc portion along the outer shape of the conductor 210 of the electrical wire 200, it is possible to realize size reduction of the insulating cover 100 as compared with the case in which the engagement portion along the outer shape of the insulator 220 of the electrical wire 200 is provided even if the arc portion 120 is formed to be greater than 180 degrees in the embodiment.

In the embodiment, the cover main body 110 includes the first cover portion 111 that covers the tubular portion 310 of the crimp terminal 300 in the +X direction and the first end portion **110*e*1 located on the side opposite to the engagement portion 120 with respect to the first cover portion 111. The first end portion 110*e*1 faces the plate portion 320 of the crimp terminal 300 in the +Z direction. With such a configuration, the restriction of the position with respect to the electrical wire unit U is performed with the engagement portion 120 and the first end portion 110*e*1 of the insulating cover 100 at positions on both sides of the first cover portion 111 in the Z direction, respectively. In this manner, the position of the insulating cover 100** is more easily stabilized.

In the embodiment, the first end portion **110*e*1 of the cover main body 110 has the cut-off portion 114A that is engaged with the plate portion 320 of the crimp terminal 300 at least in the +Z direction. With such a configuration, the position of the cover main body 110 is more reliably restricted by the plate portion 320 of the crimp terminal 300. In this manner, the position of the insulating cover 100** is more stabilized.

In the embodiment, the cut-off portion 114A is engaged with the plate portion 320 of the crimp terminal 300 in the +X direction in addition to the +Z direction. With Such a configuration, rotation of the insulating cover 100 in the circumferential direction of the electrical wire 200 is curbed. In this manner, it is possible to avoid a situation in which one or more insulating covers 100 rotate and open portions of two insulating covers 100 face each other in the configuration as illustrated in FIG. 10, for example.

Second Embodiment

Next, a second embodiment will be described. The second embodiment is different from the first embodiment in that the insulating cover 100 has a lid 140. In addition, configurations other than those described below are similar to those in the first embodiment.

Figure 11:
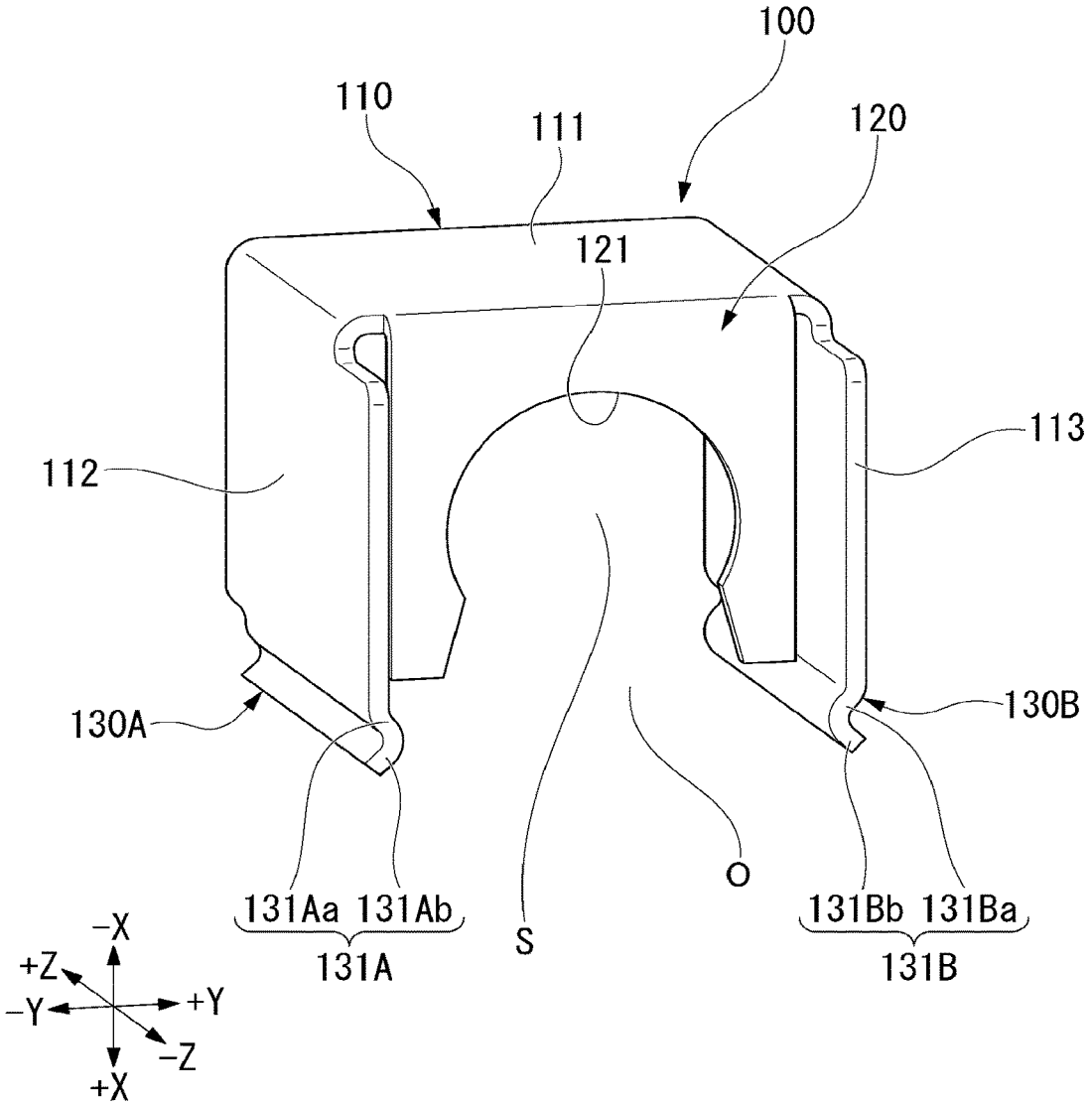
FIG. 11 is a perspective view illustrating an insulating cover according to a second embodiment.

FIG. 11 is a perspective view illustrating the insulating cover 100 according to the second embodiment. In the embodiment, the first support portion 130A includes a first narrowed portion 131A that is bent in a direction in which the first support portion 130A approaches the second support portion 130B. For example, the first narrowed portion 131A is provided over the entire length of the second cover portion 112 in the Z direction. The first narrowed portion 131A includes a first portion 131Aa that is folded in a direction in which the first narrowed portion 131A approaches the second support portion 130B from the end of the second cover portion 112 on the +X direction side and a second portion 131Ab that is folded in a direction opposite to that of the first portion 131Aa from the end of the first portion 131Aa on the +X direction side.

The first portion 131Aa is formed to follow the outer shape of the insulator 220 of the electrical wire 200 and the outer shape of the tubular portion 310 of the crimp terminal 300 and faces the insulator 220 of the electrical wire 200 and the tubular portion 310 of the crimp terminal 300. For example, the first portion 131Aa is located on the side opposite to the engagement portion 120 with respect to a part of the electrical wire 200 and supports the insulator 220 of the electrical wire 200 on the side opposite to the engagement portion 120. In a case in which the outer diameter of the tubular portion 310 of the crimp terminal 300 is substantially the same as or greater than the outer diameter of the insulator 220 of the electrical wire 200, the first portion 131Aa may support the tubular portion 310 of the crimp terminal 300 in addition to the insulator 220 of the electrical wire 200 or instead of the insulator 220 of the electrical wire 200.

Similarly, the second support portion 130B includes a second narrowed portion 131B that is bent in a direction in which the second portion 130B approaches the first support portion 130A. For example, the second narrowed portion 131B is provided over the entire length of the third cover portion 113 in the Z direction. The second narrowed portion 131B includes a first portion 131Ba that is folded in a direction in which the second narrowed portion 131B approaches the first support portion 130A from the end of the third cover portion 113 on the +X direction side and a second portion 131Bb that is folded in a direction opposite to that of the first portion 131Ba from the end of the first portion 131Ba on the +X direction side.

The first portion 131Ba is formed to follow the outer shape of the insulator 220 of the electrical wire 200 and the outer shape of the tubular portion 310 of the crimp terminal 300 and faces the insulator 220 of the electrical wire 200 and the tubular portion 310 of the crimp terminal 300. For example, the first portion 131Ba is located on the side opposite to the engagement portion 120 with respect to a part of the electrical wire 200 and supports the insulator 220 of the electrical wire 200 on the side opposite to the engagement portion 120. In a case in which the outer diameter of the tubular portion 310 of the crimp terminal 300 is substantially the same as or greater than the outer diameter of the insulator 220 of the electrical wire 200, the first portion 131Ba may support the tubular portion 310 of the crimp terminal 300 in addition to the insulator 220 of the electrical wire 200 or instead of the insulator 220 of the electrical wire 200.

Figure 12:
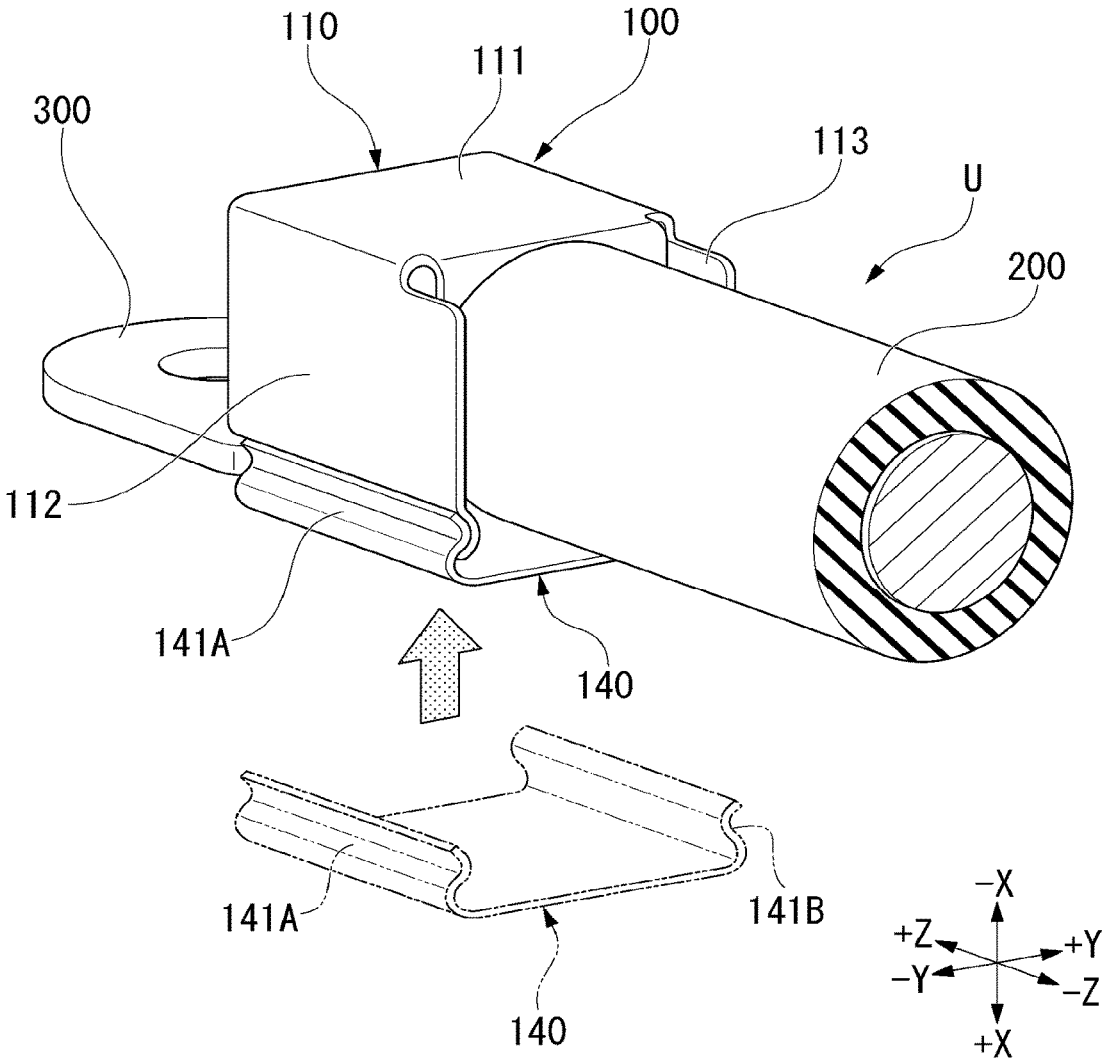
FIG. 12 is a perspective view illustrating an electrical wire unit and the insulating cover according to the second embodiment.

FIG. 12 is a perspective view illustrating the electrical wire unit U and the insulating cover 100 according to the second embodiment. In the embodiment, the insulating cover 100 includes the lid 140 that is detachably attached to the cover main body 110 and covers the electrical wire 200 on the side opposite to the cover main body 110. The lid 140 is formed from an insulating material such as a synthetic resin (for example, the same material as that of the cover main body 110).

The lid 140 includes a first engagement portion 141A that is engaged with the first narrowed portion 131A from the outside and a second engagement portion 141B that is engaged with the second narrowed portion 131B from the outside. The lid 140 is detachably attached to the cover main body 110 by the first and second engagement portions 141A and 141B being engaged with the first and second narrowed portions 131A and 131B.

With such a configuration, it is possible to secure higher insulation of the tubular portion 310 of the crimp terminal 300. For example, it is possible to secure high insulation for the tubular portion 310 of the crimp terminal 300 with the configuration according to the embodiment even in a case in which the terminal base 400 is placed in a posture other than flat placement in addition to a case in which the terminal base 400 is flatly placed. "The case in which the terminal base 400 is flatly placed" means that the terminal base 400 is placed with the first main surface 321 of the crimp terminal 300 facing upward. "The case in which the terminal base 400 is placed in a posture other than flat placement" means, for example, a case in which the terminal base 400 is attached to a poll or the like with the first main surface 321 of the crimp terminal 300 directed in the horizontal direction and the terminal base 400 on the back side is exposed to the outside. In this case, the tubular portion 310 of the crimp terminal 300 on the back side is not covered, and the tubular portion 310 of the crimp terminal 300 is exposed to the outside of the insulating cover 100 according to the first embodiment. Therefore, in a case in which the terminal base 400 is mounted in a posture other than the flat placement, there still remains a probability that a conductive foreign matter M or the like flying over cooling wind, or the like is brought into contact with tubular portions 310 across a plurality of crimp terminals 300 and the tubular potions 310 of the plurality of crimp terminals 300 are short-circuited.

Thus, the insulating cover 100 further includes the lid 140 that is detachably attached to the cover main body 110 and covers the electrical wire 200 on the side opposite to the cover main body 110. In this manner, the tubular portion 310 of the crimp terminal 300 is not exposed to the outside even in a case in which the terminal base 400 is placed in a posture other than flat placement. Therefore, it is possible to secure higher insulation for the tubular portion 310 of the crimp terminal 300. Also, it is possible to omit the lid 140 in a case in which the terminal base 400 is flatly placed according to the embodiment. In this manner, it is possible to reduce the number of processes for a placement operation in the case in which the terminal base 400 is flatly placed.

In the embodiment, the pair of supporters 130A and 130B includes a pair of narrowed portions 131A and 131B that are provided at an end of the cover main body 110 and are bent in a direction in which the narrowed portions 131A and 131B approach each other. The lid 140 is attached to the cover main body 110 by being engaged with the pair of narrowed portions 131A and 131B. With such a configuration, it is possible to attach the lid 140 to the cover main body 110 using the supporters 130A and 130B that support the electrical wire 200. In this manner, it is possible to simplify the shape of the insulating cover 100 as compared with a case in which a special structure for supporting the lid 140 is provided. In this manner, it is possible to realize reduction of manufacturing costs and the like of the insulating cover 100.

Third Embodiment

Next, a third embodiment will be described. The third embodiment is different from the first embodiment in that the insulating cover 100 can be attached to the electrical wire unit U in a plurality of directions. In addition, configurations other than those described below are similar to those in the first embodiment.

Figure 13:
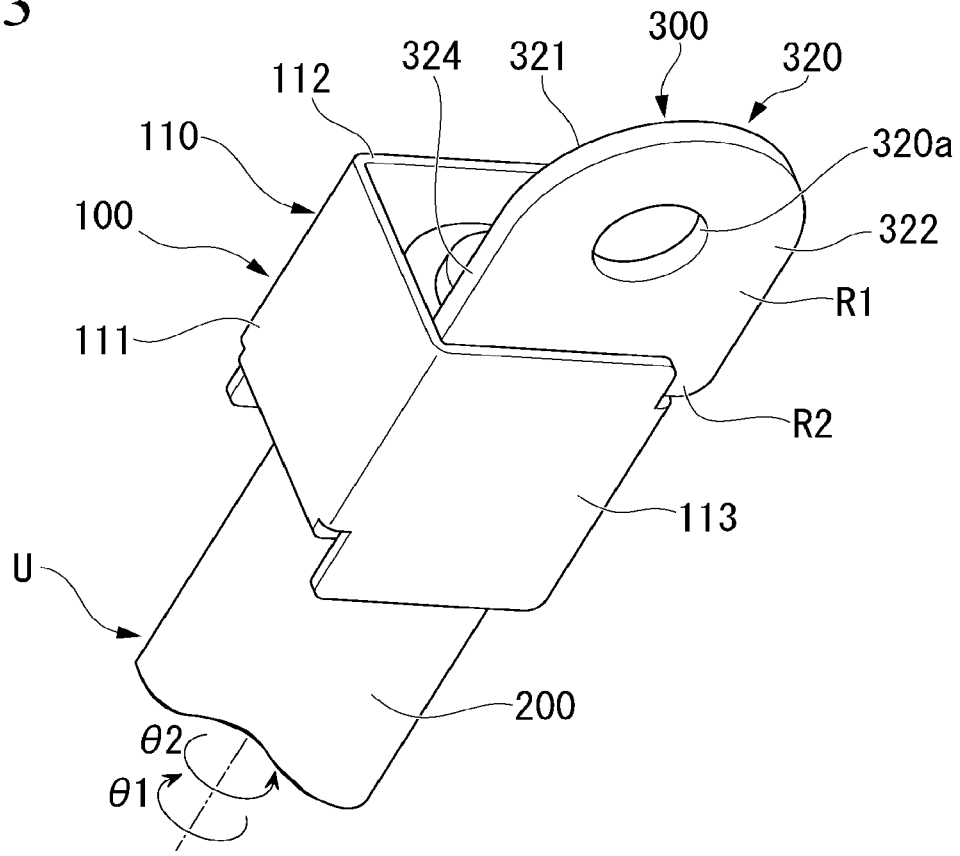
FIG. 13 is a perspective view illustrating an electrical wire unit and an insulating cover according to a third embodiment.

FIG. 13 is a perspective view illustrating the electrical wire unit U and the insulating cover 100. In the embodiment, it is possible to attach the insulating cover 100 to the electrical wire unit U in an arbitrary direction selected from a first attachment direction, a second attachment direction, and a third attachment direction in a case in which it is assumed that the same attachment direction as that in the first embodiment is the "first attachment direction, a direction that is different from the first attachment direction by 90 degrees in the second circumferential direction θ2 is the "second attachment direction", and a direction that is different from the first attachment direction by 90 degrees in the first circumferential direction θ1 is the "third attachment direction" in regard to the attachment direction of the insulating cover 100 with respect to the electrical wire unit U. Each of the second attachment direction and the third attachment direction is substantially parallel to the first main surface 321 of the plate portion 320 of the crimp terminal 300. FIG. 13 illustrates the insulating cover 100 attached in the second attachment direction as a representative.

Figure 14:
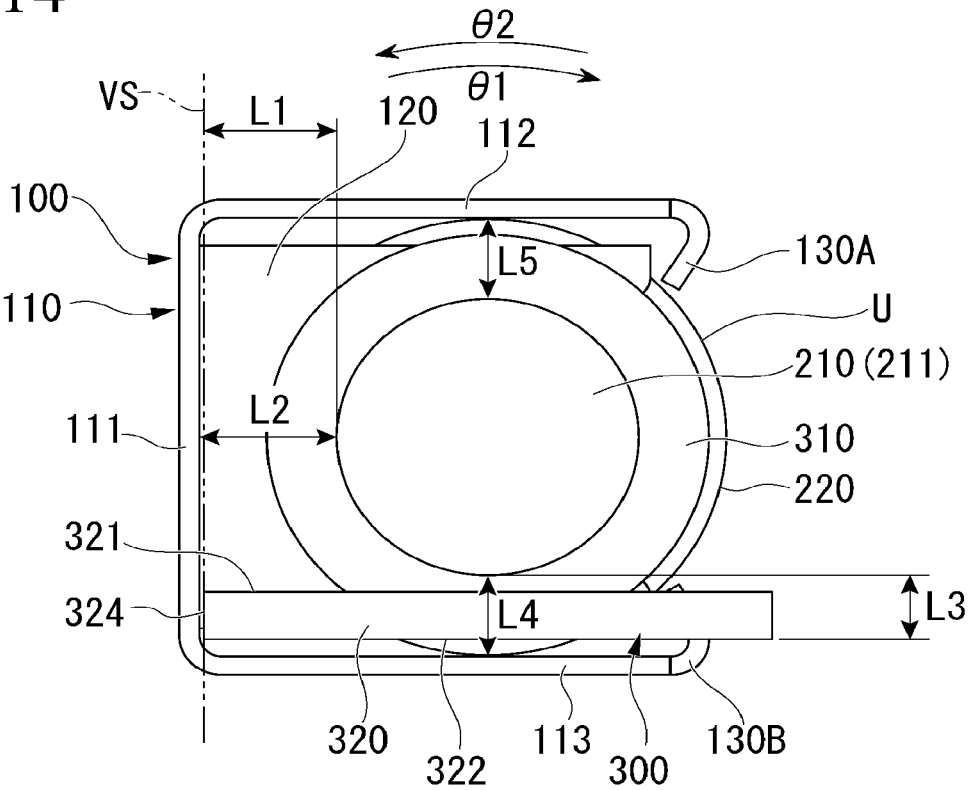
FIG. 14 is a front view illustrating the electrical wire unit and the insulating cover according to the third embodiment.

FIG. 14 is a front view illustrating the electrical wire unit U and the insulating cover 100. FIG. 14 illustrates the insulating cover 100 attached in the second attachment direction. In the embodiment, a first distance L1 and a second distance L2 will be defined as follows. The first distance L1 is a distance between a virtual surface VS obtained by extending the side surface 324 of the plate portion 320 and the inner surface of the tubular portion 310 and is the shortest distance in the direction along the first main surface 321. The second distance L2 is a shortest distance between the inner surface of the first cover portion 111 and an end surface of the engagement portion 120 (the inner circumferential surface of the arc portion 121) in contact with the end portion 211 of the conductor 210. In addition, the second distance L2 is longer than the first distance L1. With such a configuration, it is possible to avoid interference between the first cover portion 111 of the insulating cover 100 and the plate portion 320 of the crimp terminal 300, and attachment of the insulating cover 100 in the second attachment direction is allowed. In addition, the electrical wire unit U has a linearly symmetrical configuration in the left-right direction in FIG. 14. Also, the insulating cover 100 has a linearly symmetric configuration in the upward-downward direction in FIG. 14. Therefore, attachment of the insulating cover 100 in the third attachment direction is also allowed.

In addition, a third distance L3 and a fourth distance L4 are defined as follows in the embodiment. The third distance L3 is a distance between the second main surface 322 of the plate portion 320 and the inner surface of the tubular portion 310 and is the shortest distance in a direction that is substantially perpendicular to the first main surface 321. The fourth distance L4 is a shortest distance between the inner surface of the third cover portion 113 and the end surface of the engagement portion 120 (the inner circumferential surface of the arc portion 121) in contact with the end portion 211 of the conductor 210. In addition, the fourth distance L4 is longer than the third distance L3. With such a configuration, the third cover portion 113 faces the second main surface 322 of the plate portion 320 in a case in which the insulating cover 100 is attached to the electrical wire unit U in the second attachment direction. The third cover portion 113 faces the second region R2, which projects to the outside of the terminal base 400, in the plate portion 320. The third cover portion 113 is substantially parallel to the second main surface 322 of the plate portion 320. If the third cover portion 113 faces the second main surface 322 of the plate portion 320, rotation of the insulating cover 100 in the circumferential directions (the first circumferential direction θ1 and the second circumferential direction θ2) of the electrical wire 200 is restricted.

In addition, a fifth distance L5 is defined as follows in the embodiment. The fifth distance L5 is a shortest distance between the inner surface of the second cover portion 112 and the end surface of the engagement portion 120 (the inner circumferential surface of the arc portion 121) in contact with the end portion 211 of the conductor 210. In addition, the fifth distance L5 is longer than the third distance L3. With such a configuration, the second cover portion 112 faces the second main surface 322 of the plate portion 320 in a case in which the insulating cover 100 is attached to the electrical wire unit U in the third attachment direction. The second cover portion 112 faces the second region R2, which projects to the outside of the terminal base 400, in the plate portion 320. The second cover portion 112 is substantially parallel to the second main surface 322 of the plate portion 320. If the second cover portion 112 faces the second main surface 322 of the plate portion 320, rotation of the insulating cover 100 in the circumferential directions (the first circumferential direction θ1 and the second circumferential direction θ2) of the electrical wire 200 is restricted.

Figure 15:
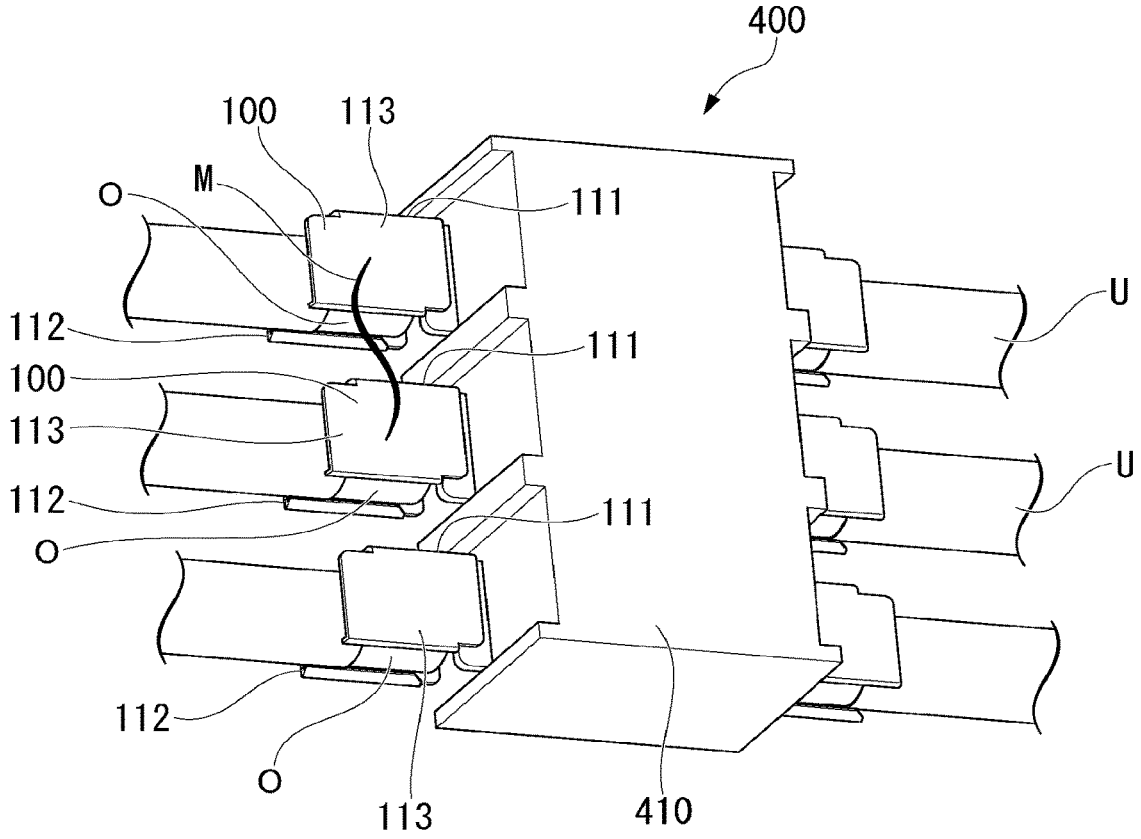
FIG. 15 is a perspective view illustrating a terminal base, a plurality of electrical wire units, and a plurality of insulating covers according to the third embodiment.

Next, a method for using the insulating cover 100 according to the embodiment will be described. FIG. 15 is a perspective view illustrating the terminal base 400, a plurality of electrical wire units U, and a plurality of insulating covers 100. As illustrated in FIG. 15, the plurality of insulating covers 100 are attached to the plurality of electrical wire units U in the mutually same direction. That is, an open portion O of an insulating cover O of the insulating cover 100 attached to an electrical wire unit U faces the first cover portion 111 of the insulating cover 100 attached to the next electrical wire unit U.

With such a configuration, the insulating cover 100 that enables selection of the first posture that is similar to that in the first embodiment, the second posture rotated by 90 degrees from the first posture, and the third posture rotated with respect to the first posture by 90 degrees in the direction opposite to that of the second posture as an attachment posture to the crimp terminal 300 is provided. In this manner, it is possible to attach the crimp terminal 300 in the posture in which the crimp terminal 300 is rotated by 90 degrees with respect to the terminal base 400. In this manner, it is possible to avoid a situation in which open portions O of the plurality of insulating covers 100 are directed in the mutually same direction. In this manner, it is possible to prevent a situation in which a conductive foreign matter M is brought into contact with the tubular portions 310 of the plurality of crimp terminals 300 and the tubular portions 310 of the plurality of crimp terminals 300 are short-circuited even in a case in which the terminal base 400 are placed in a posture other than the flat placement similarly to the second embodiment.

Fourth Embodiment

Next, a fourth embodiment will be described. The fourth embodiment is different from the first embodiment in that the engagement portion 120 of the insulating cover 100 is provided so as to be inclined with respect to the first cover portion 111. In addition, configurations other than those described below are similar to those in the first embodiment.

Figure 16:
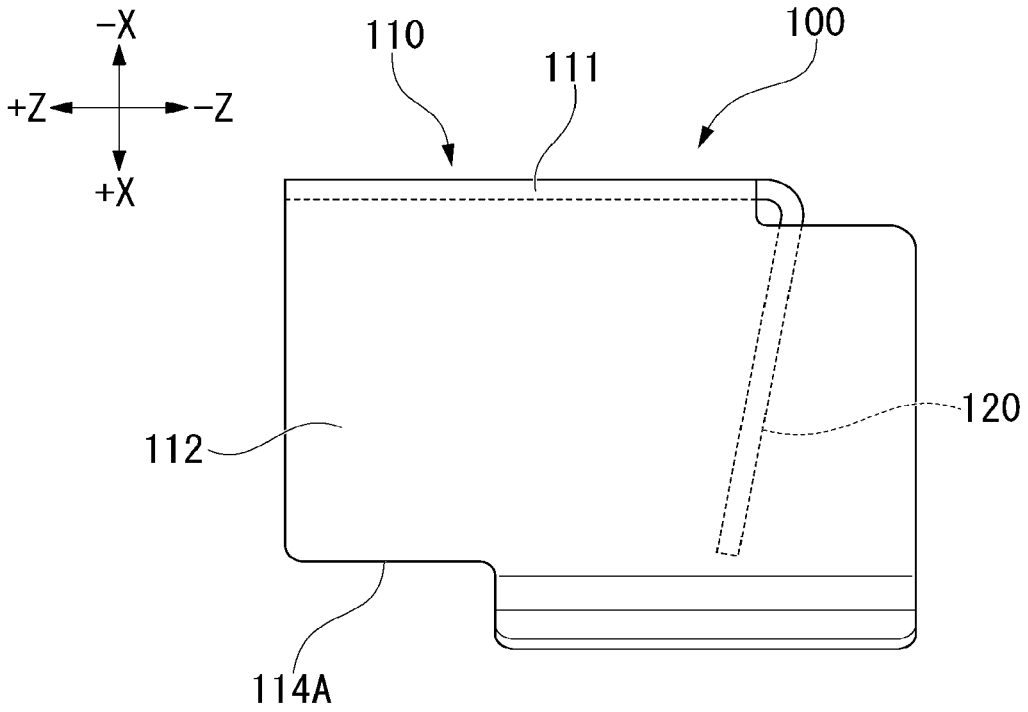
FIG. 16 is a side view illustrating an insulating cover according to a fourth embodiment.

FIG. 16 is a side view illustrating the insulating cover 100 according to the fourth embodiment. In the embodiment, the engagement portion 120 is inclined so as to advance in the +Z direction with respect to the first cover portion 111 as the engagement portion 120 is separated from the first cover portion 111. The engagement portion 120 is elastically deformable in the Z direction.

Figure 17:
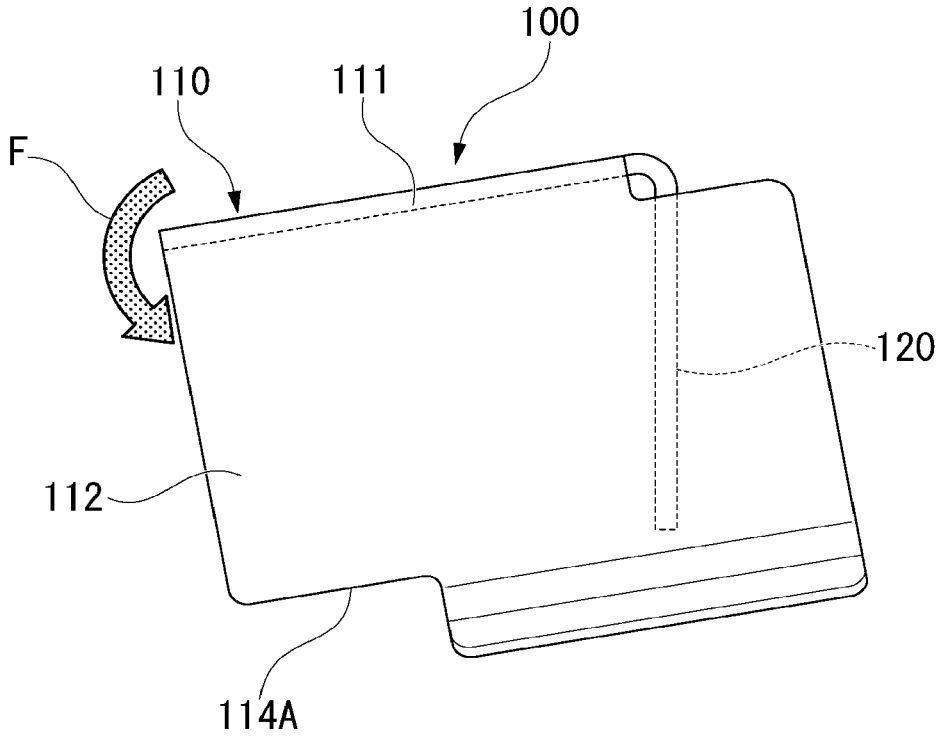
FIG. 17 is a side view illustrating the insulating cover according to the fourth embodiment.

FIG. 17 is a side view illustrating a force acting on the insulating cover 100 attached to the electrical wire unit U. In the embodiment, a pressing force F of pressing a part of the insulating cover 100 (for example, the cut-off portions 114A and 114B) toward the plate portion 320 of the crimp terminal 300 acts on the insulating cover 100 in a case in which the engagement portion 120 is inserted between the tubular portion 310 of the crimp terminal 300 and the insulator 220 of the electrical wire 200 since the engagement portion 120 is inclined so as to advance in the +Z direction with respect to the first cover portion 111 as the engagement portion 120 is separated from the first cover portion 111. For example, the part of the insulating cover 100 (for example, the cut-off portions 114A and 1114B) are pressed in the +X direction against the plate portion 320 of the crimp terminal 300 with the pressing force F.

With the configuration as described above, it is possible to curb backlash of the insulating cover 100. That is, there may be a case in which the gap g between the tubular portion 310 of the crimp terminal 300 and the insulator 220 of the electrical wire 200 increases in a case in which a large number of bent portions are provided at the electrical wire 200 in the process of arranging the electrical wire 200 or for other reasons. It is conceivable that the insulating cover 100 causes backlash with respect to the electrical wire unit U if the gap g increases.

Thus, the engagement portion 120 is provided so as to be inclined with respect to the first cover portion 111 and can be elastically deformed in the axial direction of the tubular portion 310 with respect to the first cover portion 111 in the embodiment. With such a configuration, it is possible to allow the engagement portion 120 to have a width in the Z direction with the end of the engagement portion 120 on the +X direction side and the end of the engagement portion 120 on the −X direction side and thereby to address widening of the gap g to some extent. Even in a case in which the gap g between the tubular portion 310 of the crimp terminal 300 and the insulator 220 of the electrical wire 200 is large, for example, the engagement portion 120 can maintain contact with both the tubular portion 310 of the crimp terminal 300 and the insulator 220 of the electrical wire 200. In this manner, it is possible to prevent backlash of the insulating cover 100 with respect to the electrical wire unit U. In addition, the engagement portion 120 is not limited to the case in which the engagement portion 120 is inclined so as to advance in the +Z direction with respect to the first cover portion 111 as the engagement portion 120 is separated from the first cover portion 111 and may be inclined so as to advance in the −Z direction with respect to the first cover portion 111 as the engagement portion 120 is separated from the first cover portion 111.

In the embodiment, the engagement portion 120 is inclined so as to advance in the +Z direction with respect to the first cover portion 111 as the engagement portion 120 is separated from the first cover portion 111. With such a configuration, the pressing force F of pressing a part of the insulating cover 100 (for example, the cut-off portions 114A and 114B) toward the plate portion 320 of the crimp terminal 300 acts on the insulating cover 100 by the engagement portion 120 being inserted between the tubular portion 310 of the crimp terminal 300 and the insulator 220 of the electrical wire 200. With such a configuration, the position of the insulating cover 100 is further stabilized, and rotation of the insulating cover 100 is further reliably curbed. In addition, it is also possible to more reliably prevent backlash of the insulating cover 100 with respect to the electrical wire unit U.

Fifth Embodiment

Next, a fifth embodiment will be described. The fifth embodiment is different from the first embodiment in that the engagement portion 120 includes a projection 115. In addition, configurations other than the configurations described below are similar to those in the first embodiment.

Figure 18:
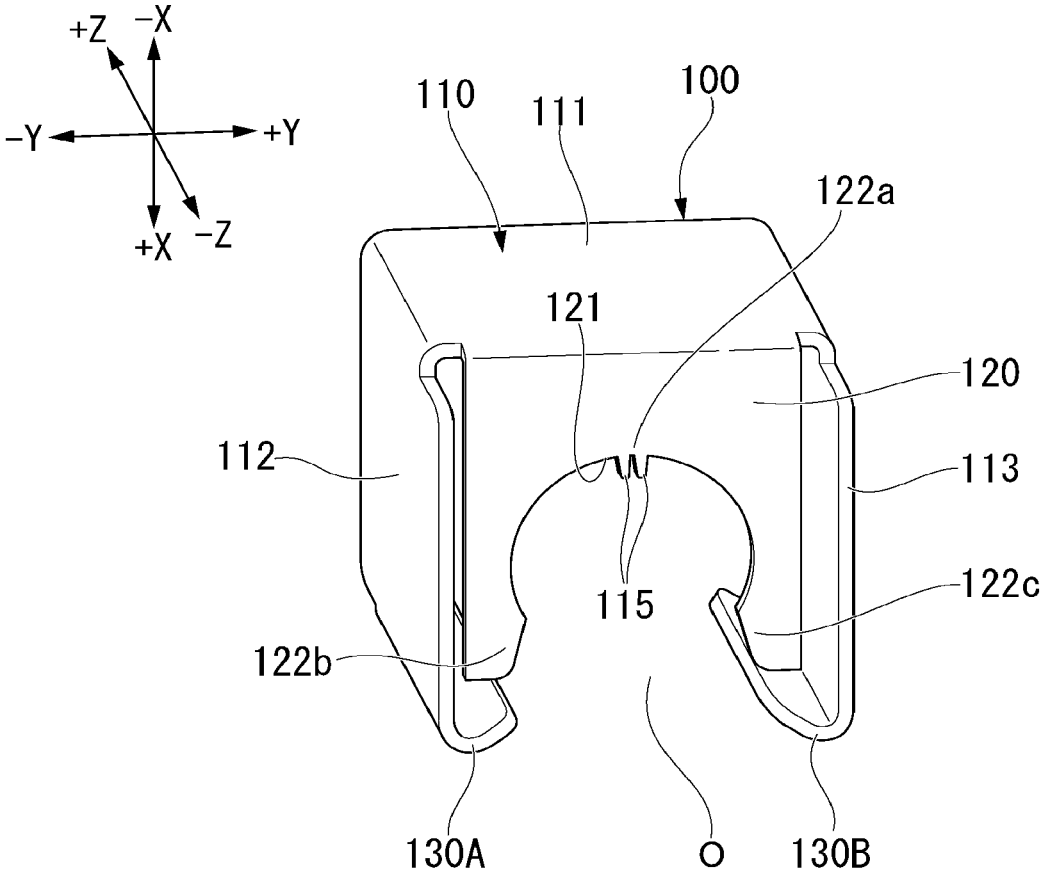
FIG. 18 is a perspective view illustrating an insulating cover according to a fifth embodiment.

FIG. 18 is a perspective view illustrating the insulating cover 100 according to the fifth embodiment. In the embodiment, the insulating cover 100 includes a projection 115. The projection 115 is provided at the first portion 122*a* of the engagement portion 120 and projects in the +X direction from the inner circumferential surface of the arc portion 121. In the embodiment, the conductor 210 of the electrical wire 200 is formed of a plurality of wires W (see FIG. 1). The projection 115 of the insulating cover 100 is inserted into the plurality of wires W in a case in which the engagement portion 120 is engaged with the conductor 210 of the electrical wire 200.

With such a configuration, it is possible to restrict rotation of the insulating cover 100 in the circumferential directions (the first circumferential direction θ1 and the second circumferential direction θ2) of the electrical wire 200 by the projection 115 of the insulating cover 100 being inserted between the plurality of wires W. In addition, the insulating cover 100 includes two projections 115 in the embodiment. However, the number of projections 115 provided at the insulating cover 100 may be one, three, or more.

Sixth Embodiment

Next, a sixth embodiment will be described. The sixth embodiment is different from the first embodiment in that the engagement portion 120 is engaged with a tip end 211*b* of the electrical wire 200. In addition, configurations other than the configurations described below are similar to those in the second embodiment.

Figure 19:
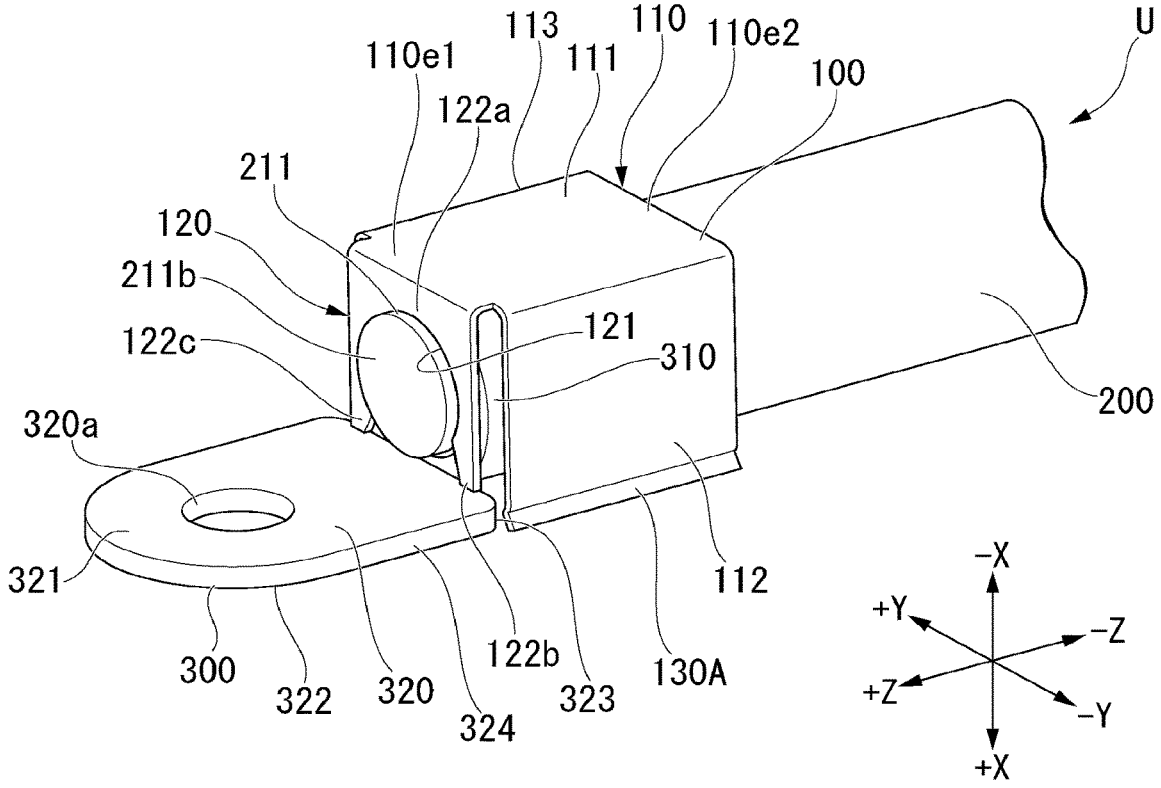
FIG. 19 is a perspective view illustrating an electrical wire unit and an insulating cover according to a sixth embodiment.

FIG. 19 is a perspective view illustrating the electrical wire unit U and the insulating cover 100 according to the sixth embodiment. The end portion 211 of the conductor 210 of the electrical wire 200 has the tip end 211*b* that projects in the +Z direction from the tubular portion 310 of the crimp terminal 300.

In the embodiment, the engagement portion 120 extends in the +X direction from the end of the first cover portion 111 on the +Z direction side. The engagement portion 120 is engaged with the tip end 211*b*, which projects from the tubular portion 310, of the end portion 211 of the conductor 210. The engagement portion 120 faces the tubular portion 310 of the crimp terminal 300 in the −Z direction by being engaged with the tip end 211*b* of the end portion 211 of the conductor 210. In this manner, the position of the engagement portion 120 in the −Z direction (the position of the insulating cover 100 in the −Z direction) is restricted by the tubular portion 310 of the crimp terminal 300.

In the embodiment, the first and second supporters 130A and 130B are located on the +X direction side beyond a part of the plate portion 320 of the crimp terminal 300. The first and second supporters 130A and 130B face the plate portion 320 of the crimp terminal 300 in the +Z direction. In this manner, the position of the insulating cover 100 in the +Z direction is restricted by the plate portion 320 of the crimp terminal 300.

In the embodiment, each of the second portion 122*b* and the third portion 122*c* of the engagement portion 120 faces the first main surface 321 of the plate portion 320 of the crimp terminal 300 in the +X direction. In this manner, the second portion 122*b* and the third portion 122*c* of the engagement portion 120 restrict rotation of the insulating cover 100 in the circumferential directions (the first circumferential direction θ1 and the second circumferential direction θ2) of the electrical wire 200.

With such a configuration, it is possible to provide highly versatile insulating cover 100 that can undergo retrofit or replacement for the purposes similar to those in the first embodiment.

Although the first to sixth embodiments have been described above, embodiments are not limited to the above examples. For example, the example in which the cover main body 110 is open only in one direction has been described in the aforementioned embodiments. However, the cover main body 110 may be open in a plurality of directions. The plate portion 320 of the crimp terminal 300 may not have the straight portion SP.

According to at least one of the aforementioned embodiments, the insulating cover includes the cover main body and the pair of supporters. The cover main body is open in one direction along the radial direction of the tubular portion of the crimp terminal, is disposed outside the terminal base, does not cover at least the region, which faces the electrical connection portion of the terminal base, in the plate portion of the crimp terminal, and covers the tubular portion. The pair of supporters face at least one of the electrical wire and the tubular portion on the side opposite to the cover main body. With such a configuration, it is possible to provide a highly versatile insulating cover that can undergo retrofit or replacement.

Although some embodiments of the invention have been described above, these embodiments are presented just as examples and are not intended to limit the scope of the invention. These embodiments can be performed in other various modes, and various omissions, replacement, and changes can be made without departing from the gist of the invention. These embodiments and modifications thereof are included in the invention described in the claims and the scope equivalent thereto as in the scope and the gist of the invention.

REFERENCE SIGNS LIST

10 Electrical connection structure
100 Insulating cover
110 Cover main body
111 First cover portion
112 Second cover portion
113 Third cover portion
114A, 114B Cut-off portion
115 Projection
120 Engagement portion
121 Arc portion
130A, 130B Supporter
131A, 131B Narrowed portion

140 Lid
200 Electrical wire
210 Conductor
211 End portion
220 Insulator
300 Crimp terminal
310 Tubular portion
320 Plate portion
320*a* Through-hole
321 First main surface
322 Second main surface
324 Side surface
400 Terminal base
412 Electrical connection portion
420 Terminal base cover
500 Fixing member
510 Head portion
R1 First region of plate portion
R2 Second region of plate portion
S Space
Sa Central portion
Sb Inlet portion

The invention claimed is:

1. An insulating cover for an electrical connection structure, the electrical connection structure including:

an electrical wire including a conductor and an insulator, the insulator covering the conductor, an end portion of the conductor projecting to an outside of the insulator, a crimp terminal including a tubular portion into which the end portion of the conductor is inserted and a plate portion provided integrally with the tubular portion, and a terminal base including an electrical connection portion to which the plate portion is connected and a cover configured to cover the plate portion on a side opposite to the electrical connection portion, the insulating cover comprising:

a cover main body that is open in at least one direction along a radial direction of the tubular portion, the cover main body being configured to be disposed outside the terminal base, the cover main body being configured not to cover at least a region of the plate portion, the region being configured to face the electrical connection portion, the cover main body being configured to cover the tubular portion;

a pair of supporters configured to face at least one of the electrical wire and the tubular portion on a side opposite to the cover main body; and an engagement portion including an arc portion along an outer shape of the conductor, the engagement portion being configured to be engaged with, in a first direction along the radial direction of the tubular portion, a region of the end portion of the conductor, the region being configured not to be covered with the tubular portion.

2. The insulating cover according to claim 1, wherein the arc portion of the engagement portion is formed at an angle greater than 180 degrees, the arc portion defining a space into which the conductor is inserted inside the engagement portion, and the space includes a central portion and an inlet portion, the inlet portion being located on a side of the first direction with respect to the central portion, the inlet portion being narrower than the central portion.

3. The insulating cover according to claim 1, wherein the end portion of the conductor includes a tip end, the tip end being configured to project to an outside of the tubular portion, and the engagement portion is configured to be engaged with the tip end of the end portion of the conductor and to face the tubular portion in an axial direction of the tubular portion.

4. The insulating cover according to claim 3, wherein the cover main body is configured to face the plate portion in a second direction along the axial direction of the tubular portion, and the engagement portion is configured to face the tubular portion in a third direction opposite to the second direction.

5. The insulating cover according to claim 1, wherein the engagement portion is configured to be inserted between the tubular portion and the insulator, to face the tubular portion in a second direction along an axial direction of the tubular portion, and to face the insulator in a third direction opposite to the second direction.

6. The insulating cover according to claim 5, wherein the cover main body includes a cover portion, the cover portion being configured to cover the tubular portion in the first direction, and the engagement portion is provided to be inclined with respect to the cover portion, the engagement portion being elastically deformable in the axial direction of the tubular portion.

7. The insulating cover according to claim 5, wherein the cover main body includes a cover portion and a first end portion, the cover portion being configured to cover the tubular portion in the first direction, the first end portion being located on a side opposite to the engagement portion with respect to the cover portion in the axial direction of the tubular portion, and the first end portion is configured to face the plate portion in the second direction.

8. The insulating cover according to claim 7, wherein the first end portion includes a cut-off portion, the cut-off portion being configured to be engaged with the plate portion in at least the second direction.

9. The insulating cover according to claim 8, wherein the cut-off portion is configured to be engaged with the plate portion in the first direction in addition to the second direction.

10. The insulating cover according to claim 9, wherein the cover main body includes a cover portion, the cover portion being configured to cover the tubular portion in the first direction, and the engagement portion is provided to be inclined such that the engagement portion advances in the second direction with respect to the cover portion as the engagement portion is separated from the cover portion, the engagement portion being configured to apply, on the insulating cover, a pressing force to press the cut-out portion against the plate portion by the engagement portion being inserted between the tubular portion and the insulator.

11. An insulating cover for an electrical connection structure, the electrical connection structure including:

an electrical wire including a conductor and an insulator, the insulator covering the conductor, an end portion of the conductor projecting to an outside of the insulator, a crimp terminal including a tubular portion into which the end portion of the conductor is inserted and a plate portion provided integrally with the tubular portion, and a terminal base including an electrical connection portion to which the plate portion is connected and a cover configured to cover the plate portion on a side opposite to the electrical connection portion, the insulating cover comprising:

a cover main body that is open in at least one direction along a radial direction of the tubular portion, the cover main body being configured to be disposed outside the terminal base, the cover main body being configured not to cover at least a region of the plate portion, the region being configured to face the electrical connection portion, the cover main body being configured to cover the tubular portion;

a pair of supporters configured to face at least one of the electrical wire and the tubular portion on a side opposite to the cover main body; and a lid configured to be detachably attached to the cover main body and to cover the electrical wire on a side opposite to the cover main body, wherein, the pair of supporters is provided at an end portion of the cover main body and includes a pair of narrowed portions bent in a direction in which the narrowed portions approach each other, and the lid is configured to be attached to the cover main body by the lid being engaged with the pair of narrowed portions.

12. An insulating cover for an electrical connection structure, the electrical connection structure including:

an electrical wire including a conductor and an insulator, the insulator covering the conductor, an end portion of the conductor projecting to an outside of the insulator, a crimp terminal including a tubular portion into which the end portion of the conductor is inserted and a plate portion provided integrally with the tubular portion, and a terminal base including an electrical connection portion to which the plate portion is connected and a cover configured to cover the plate portion on a side opposite to the electrical connection portion, the insulating cover comprising:

a cover main body that is open in at least one direction along a radial direction of the tubular portion, the cover main body being configured to be disposed outside the terminal base, the cover main body being configured not to cover at least a region of the plate portion, the region being configured to face the electrical connection portion, the cover main body being configured to cover the tubular portion; and a pair of supporters configured to face at least one of the electrical wire and the tubular portion on a side opposite to the cover main body, wherein, the plate portion includes a first main surface and a side surface, the first main surface having the largest area among surfaces of the plate portion, the side surface being substantially perpendicular with the first main surface, the cover main body includes a first cover section, a second cover section, a third cover section, and an engagement portion, the first cover portion being configured to cover the tubular portion in a first direction along the radial direction of the tubular portion, the second cover portion being configured to cover the tubular portion in a direction that is different from the direction of the first cover portion, the third cover portion being configured to cover the tubular portion on a side opposite to the second cover portion, the engagement portion being configured to be engaged with the end portion of the conductor in the first direction, the engagement portion having an end surface that is configured to be in contact with the end portion of the conductor, and in a case that a shortest distance between a virtual surface obtained by extending the side surface of the plate portion and an inner surface of the tubular portion in a direction along the first main surface is a first distance, and a shortest distance between an inner surface of the first cover portion and an end surface of the engagement portion is a second distance, the second distance is longer than the first distance.

13. The insulating cover according to claim 12, wherein the plate portion includes a through-hole and a second main surface, the through-hole being configured to receive a fixing member that is a screw or a bolt, the second main surface being located on a side opposite to the first main surface, the first main surface being configured to face a head portion of the fixing member, and in a case that the insulating cover is attached to the electrical wire in a direction substantially parallel to the first main surface of the plate portion, one of the second cover portion and the third cover portion faces the second main surface of the plate portion.

* * * * *